US012446696B2

(12) United States Patent
Anderson et al.

(10) Patent No.: US 12,446,696 B2
(45) Date of Patent: Oct. 21, 2025

(54) HEADREST FOR SELECTIVELY REMOVABLE SPA SEATBACK

(71) Applicant: BULLFROG INTERNATIONAL, LC, Herriman, UT (US)

(72) Inventors: Todd Anderson, Lehi, UT (US); Eric Hales, Eagle Mountain, UT (US); Michael Andersen, American Fork, UT (US)

(73) Assignee: BULLFROG INTERNATIONAL, LC, Herriman, UT (US)

( * ) Notice: Subject to any disclaimer, the term of this patent is extended or adjusted under 35 U.S.C. 154(b) by 254 days.

(21) Appl. No.: 18/099,758

(22) Filed: Jan. 20, 2023

(65) Prior Publication Data

US 2024/0245220 A1 Jul. 25, 2024

(51) Int. Cl.
*A47C 7/38* (2006.01)

(52) U.S. Cl.
CPC ..... *A47C 7/383* (2013.01)

(58) Field of Classification Search
CPC .. A47C 7/383; A47C 1/10; A47K 3/10; A47K 3/125
See application file for complete search history.

(56) References Cited

U.S. PATENT DOCUMENTS 2,200,247 A * 5/1940 Haas ..... A47K 3/125 4/575.1
3,078,474 A * 2/1963 Chaitlen ..... A47K 3/125 4/575.1
4,839,930 A * 6/1989 Watkins ..... A61H 33/6089 4/546
4,908,888 A * 3/1990 Watkins ..... A61H 33/6089 4/541.3
5,682,625 A * 11/1997 Leaverton ..... A61H 33/6063 4/546
5,716,333 A * 2/1998 Larsen ..... A61H 33/6089 4/575.1
5,987,663 A 11/1999 Ludlow et al.
(Continued)

FOREIGN PATENT DOCUMENTS

CA 2524556 A1 * 5/2006 ..... A61H 33/60
CN 105595657 A * 5/2016 ..... A47C 1/06
(Continued)

OTHER PUBLICATIONS

Hungary Patent Office, "Office Action," Hungary Application No. U2300071, Sep. 15, 2023.
(Continued)

*Primary Examiner* — Timothy J Brindley
(74) *Attorney, Agent, or Firm* — Dentons Durham Jones Pinegar; Sarah W. Matthews; Lilly Godfrey

(57) ABSTRACT

This disclosure relates generally to systems, devices, and methods of use thereof regarding headrests for selectively removable spa seatbacks. In some embodiments, headrests of the present disclosure include a pillow and a manifold to (a) receive the pillow and (b) selectively engage the selectively removable spa seatback. In some embodiments, headrests of the present disclosure include a pillow and a manifold, where the manifold includes a platform to receive the pillow, a body for engaging with the selectively removable spa seatback, and a constraining plate to restrict a movement of a portion of the body.

15 Claims, 20 Drawing Sheets

(56) References Cited

U.S. PATENT DOCUMENTS

| | | | | |
|---|---|---|---|---|
| 7,908,684 | B2 * | 3/2011 | Ludlow | A61H 33/02 4/584 |
| 7,996,932 | B2 * | 8/2011 | Elnar | A61H 33/601 4/575.1 |
| 8,176,578 | B2 * | 5/2012 | Hatrick-Smith | A61H 33/60 4/575.1 |
| 9,662,268 | B2 * | 5/2017 | Eddington | A61H 33/6063 |
| 10,660,479 | B1 | 5/2020 | Knight | |
| 10,874,221 | B1 * | 12/2020 | Lin | A47C 7/38 |
| 11,375,815 | B1 * | 7/2022 | Barnes | A47C 4/00 |
| 11,951,071 | B2 * | 4/2024 | Arsin | A61H 9/0007 |
| 2009/0241255 | A1 | 10/2009 | Elnar | |
| 2014/0131472 | A1 | 5/2014 | Eddington | |
| 2017/0280879 | A1 * | 10/2017 | Smith | A47C 16/04 |
| 2023/0270254 | A1 * | 8/2023 | Reyes | A47C 7/38 297/397 |
| 2024/0115049 | A1 * | 4/2024 | Parsons | A47C 7/546 |
| 2024/0324782 | A1 * | 10/2024 | Mainridge | A47C 7/383 |

FOREIGN PATENT DOCUMENTS

| | | | | |
|---|---|---|---|---|
| CN | 208957896 | U | 6/2019 | |
| CN | 110638244 | A * | 1/2020 | A47C 7/38 |
| EP | 4368067 | | 5/2024 | |
| JP | 2022049187 | A | 3/2022 | |
| KR | 102022546 | B1 * | 9/2019 | |
| KR | 102222110 | B1 * | 3/2021 | |
| KR | 20210029510 | A * | 3/2021 | |
| WO | 2014071422 | A1 | 5/2014 | |

OTHER PUBLICATIONS

Patent Office, "Combined Search and Examination Report under Section 17 and 18(3)," Application No. GB2305184.0, Oct. 18, 2023.

Australian Patent Office, "AU Examination Report No. 1," Australian Application No. 2023202306, Apr. 24, 2024.

New Zealand Patent Office, "NZ Examination Report No. 1," New Zealand Application No. 799058, Nov. 22, 2024.

Canadian Patent Office, "Requisition," Canadian application No. 3,195,715, dated Jan. 27, 2025.

United Kingdom Intellectual Property Office, "Second Examination Report," for UK Application No. 2305184.0, Feb. 13, 2025.

* cited by examiner

HEADREST FOR SELECTIVELY REMOVABLE SPA SEATBACK

TECHNICAL FIELD

This disclosure relates generally to headrests for spas, and more specifically to headrests for selectively removable spa seatbacks and methods of use thereof.

SUMMARY

Disclosed are systems, devices, and methods of use thereof for headrests that selectively engage with selectively removable spa seatbacks. Specifically, disclosed are headrests for selectively engaging with a selectively removable spa seatback, where the selectively removable spa seatback can also engage with a spa, such as a hot tub. In some embodiments, headrests of the present disclosure include a pillow having a curved portion and a flat portion. Embodiments of the headrests additionally include a headrest manifold, where the headrest manifold includes a platform to receive the pillow. The platform includes opposing divots on a top surface of the platform for engaging the flat portion of the pillow and opposing brackets extending downwardly from a bottom surface of the platform to engage (e.g., slidably engage or slidably receive) a portion of the selectively removable spa seatback.

In some embodiments, the manifold additionally includes a body extending from the bottom of the platform. The body includes a pair of arms, where each arm of the pair includes a winged portion and a clamp portion for engaging the selectively removable spa seatback. In some embodiments, the winged portion engages the selectively removable spa seatback orthogonally (i.e., perpendicularly or normally) to the clamp portion. In some embodiments, the manifold further includes a constraining plate disposed within a slot formed by the platform. The constraining plate constrains or otherwise restricts at least one movement of the winged portion of the body such that the winged portion cannot be removed from the spa seatback once the constraining plate is in place. Additionally, and/or alternatively, the constraining plate can have a slot that engages with tabs (e.g., an elongated tab or a plurality of tabs) of the body and/or the platform.

In some embodiments, headrests of the present disclosure include a pillow and a manifold, the manifold to (a) receive the pillow and (b) selectively engage the selectively removable spa seatback.

Also disclosed are methods of connecting a headrest to a spa, such as a hot tub. In some embodiments, methods include selecting a headrest, attaching the headrest to a selectively removable spa seatback, and inserting the selectively removable spa seatback with the attached headrest to the spa.

In some embodiments, methods include selecting a headrest, engaging a front plate of a selectively removable spa seatback, engaging top wings of a back manifold of the selectively removable spa seatback, and inserting the selectively removable spa seatback with the attached headrest to the spa. The methods also allow a user to remove a selectively removable spa seatback from the spa without separately disengaging the attached headrest (i.e., the headrest and selectively removable spa seatback can be removed, replaced, interchanged, etc., as a single unit).

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
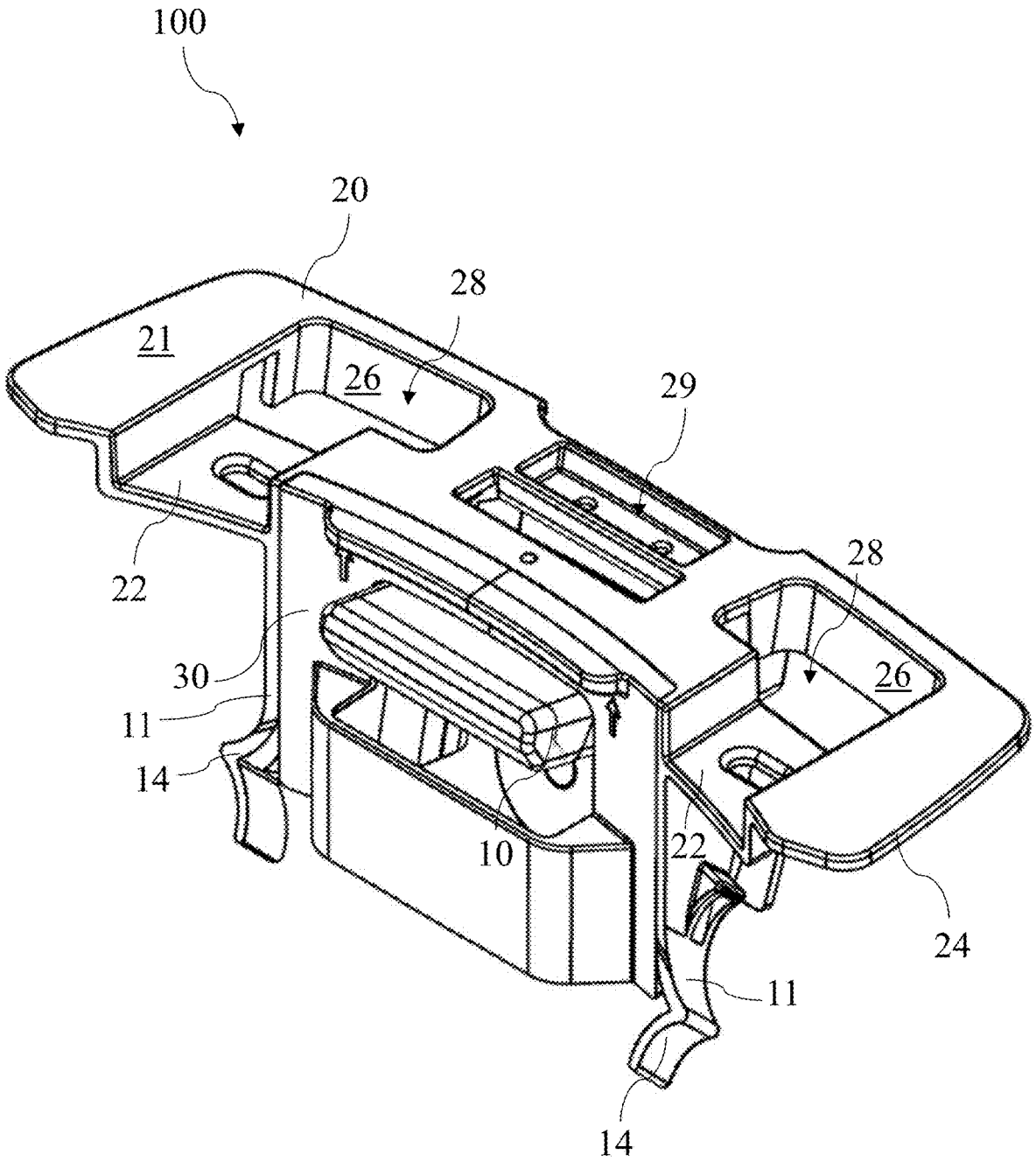
FIG. 1 illustrates a front perspective view of a manifold for a headrest, according to embodiments of the present disclosure.

Disclosed are systems, devices, and methods of use thereof for headrests for selectively removable spa seatbacks. Specifically, disclosed are headrests for selectively engaging with a selectively removable spa seatback, where the selectively removable spa seatback can engage with a spa, such as a hot tub. In some embodiments, headrests of the present disclosure include a pillow having a curved portion and a flat portion. The headrests additionally include a manifold, where the manifold includes a platform to receive the pillow. In some embodiments, the platform includes opposing divots on a top surface of the platform for engaging the flat portion of the pillow and opposing brackets extending downwardly from a bottom surface of the platform to slidably engage the selectively removable spa seatback.

The manifold additionally includes a body extending from the bottom of the platform. The body includes a pair of arms, where each arm of the pair includes a winged portion for engaging the selectively removable spa seatback and a clamp portion for engaging the selectively removable spa seatback. In some embodiments, the winged portion engages the selectively removable spa seatback orthogonally (i.e., perpendicularly) to the clamp portion. That is, an engagement of the selectively removable spa seatback by the winged portion is orthogonal or perpendicular to an engagement of the selectively removable spa seatback by the clamp portion. In some embodiments, the manifold further includes a constraining plate disposed within a slot formed by the platform. Additionally, and/or alternatively, the constraining plate may be disposed over one or more tabs formed by the body and/or the platform of the manifold. The constraining plate constrains or otherwise restricts at least one movement of the winged portion of the body.

In some embodiments, headrests of the present disclosure include a pillow and a manifold to (a) receive the pillow and (b) selectively engage the selectively removable spa seatback.

Referring to FIGS. 1-4, views of a manifold 100 for a headrest are shown according to an embodiment of the present disclosure. The headrest is described more fully below with respect to FIGS. 6-17. As illustrated, the manifold 100 (or headrest manifold 100) generally includes a platform 20, a body 10, and a constraining plate 30. The platform 20 has a top surface 21 and a bottom surface 27 (see FIG. 3). In some embodiments, the platform 20 and/or the top surface 21 includes or defines divots 22, such as the opposing divots 22 illustrated in FIG. 1. The platform 20 and/or the top surface 21 also includes lips or overhangs 24 on opposing sides of the platform 20. As described more fully below, the overhangs 24 engage or interface with edges of a pillow that is received by the platform 20.

The body 10 of the headrest manifold 100 includes a pair of arms 11 which, in some embodiments, flank or otherwise interface with the constraining plate 30. In some embodiments, the constraining plate 30 is received by a slot formed by the platform 20. The constraining plate 30 can be disposed within the slot and may be disposed adjacent or next to a front edge of the platform 20. In some embodiments, the constraining plate 30 is received by a slot formed by the body 10. In some embodiments, the constraining plate 30 is received by a slot formed or defined by both the body 10 and the platform 20. In some embodiments, tabs formed on the body and/or the platform interact with slots formed in the constraining plate 30 to secure the constraining plate 30 to the manifold 100 (see FIGS. 5A and 5B, discussed in more detail below).

Figure 2:
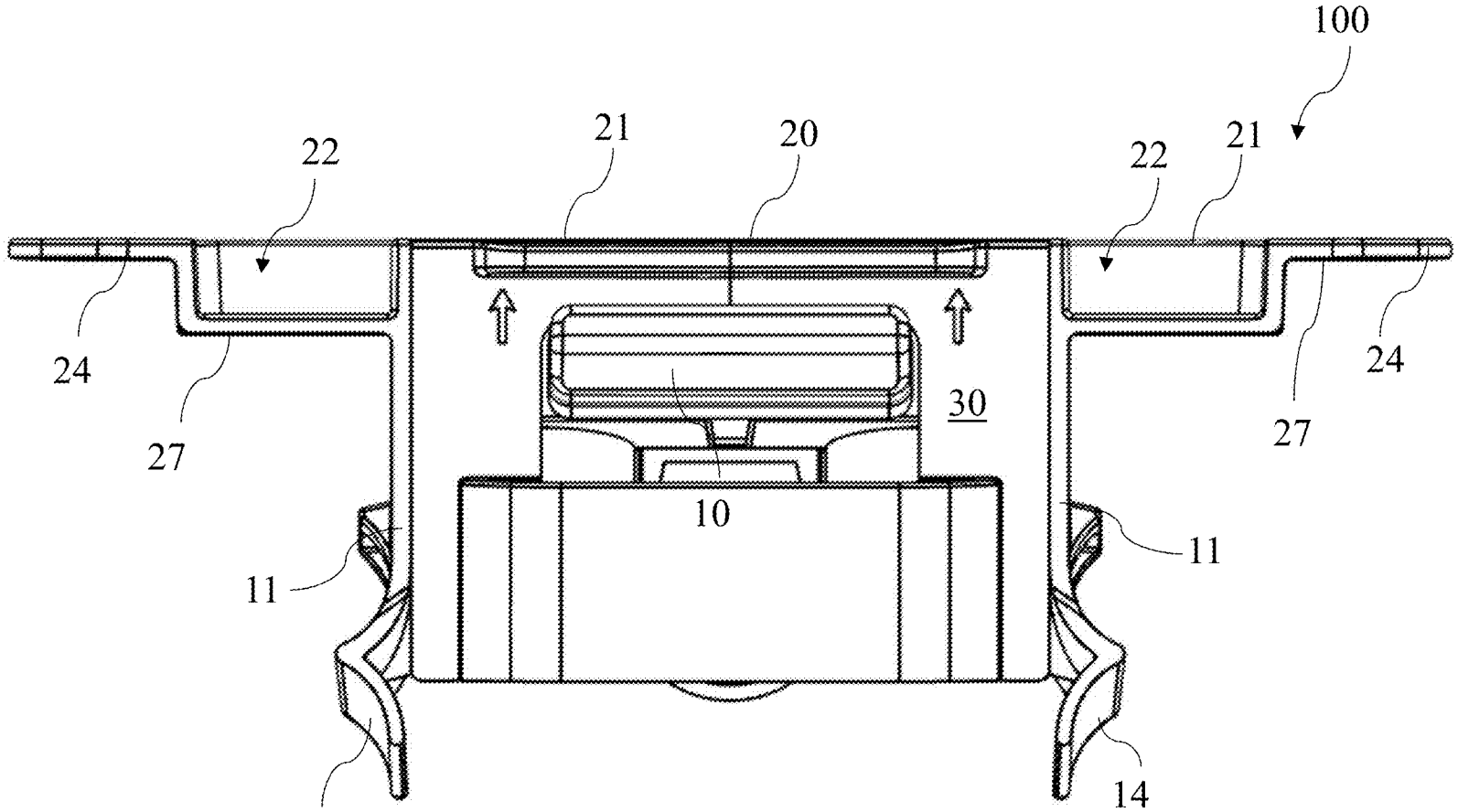
FIG. 2 illustrates a front view of a manifold for a headrest.
Figure 3:
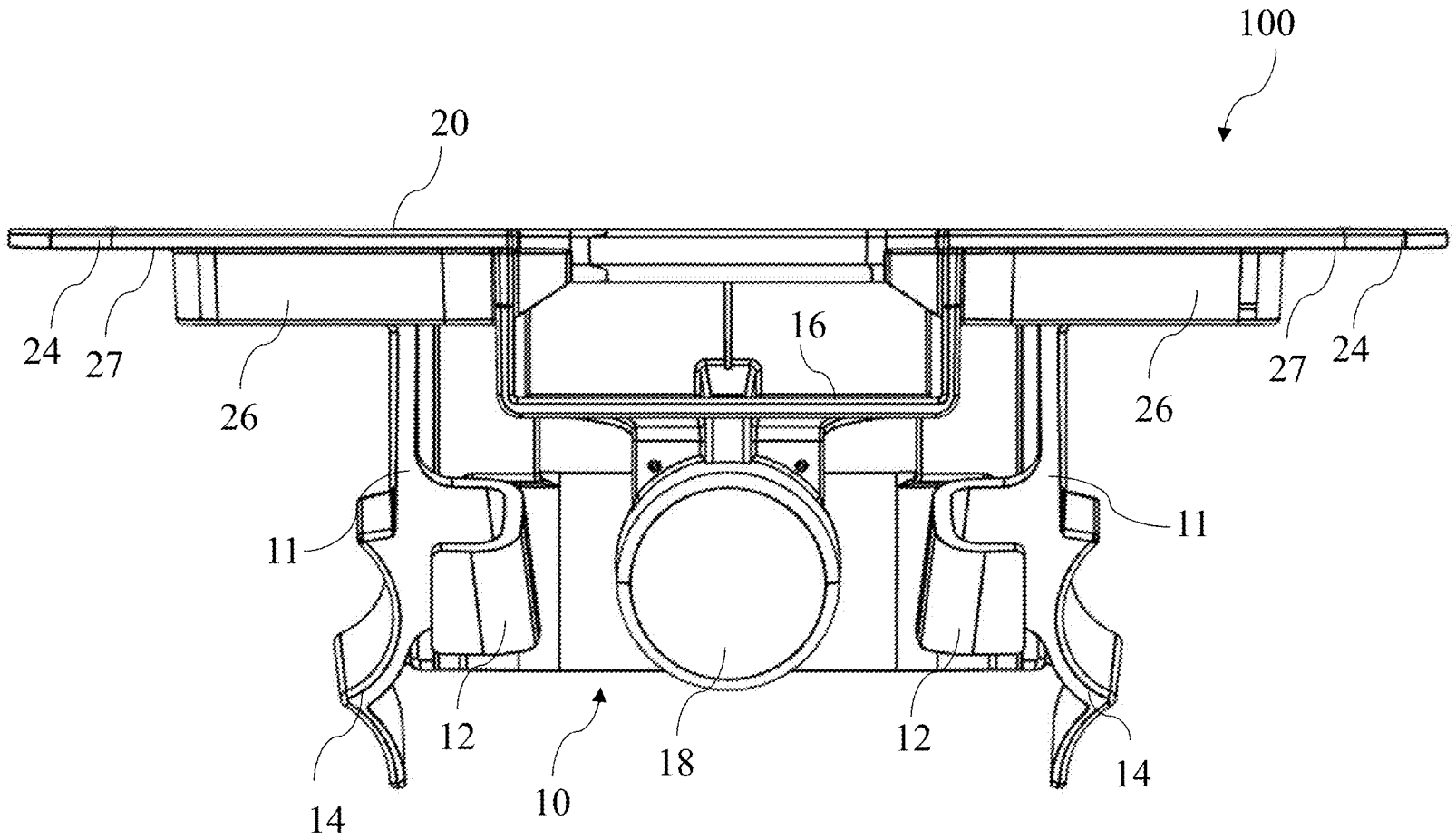
FIG. 3 illustrates a back view of the manifold of FIG. 1.

FIG. 3 illustrates a back view of the manifold 100 of FIG. 1. Referring to FIGS. 2 and 3, in some embodiments, each arm 11 of the pair of arms 11 includes a clamp portion 12 and a winged portion 14. Both the clamp portion 12 and the winged portion 14 engage a selectively removable spa seatback and/or portions of the selectively removable spa seatback. In other embodiments, the arm(s) may include a clamp portion 12 only, a winged portion 14 only, or combinations of the clamp and/or winged portion. Similarly, one arm may be provided, or two arms may be provided.

Figure 4:
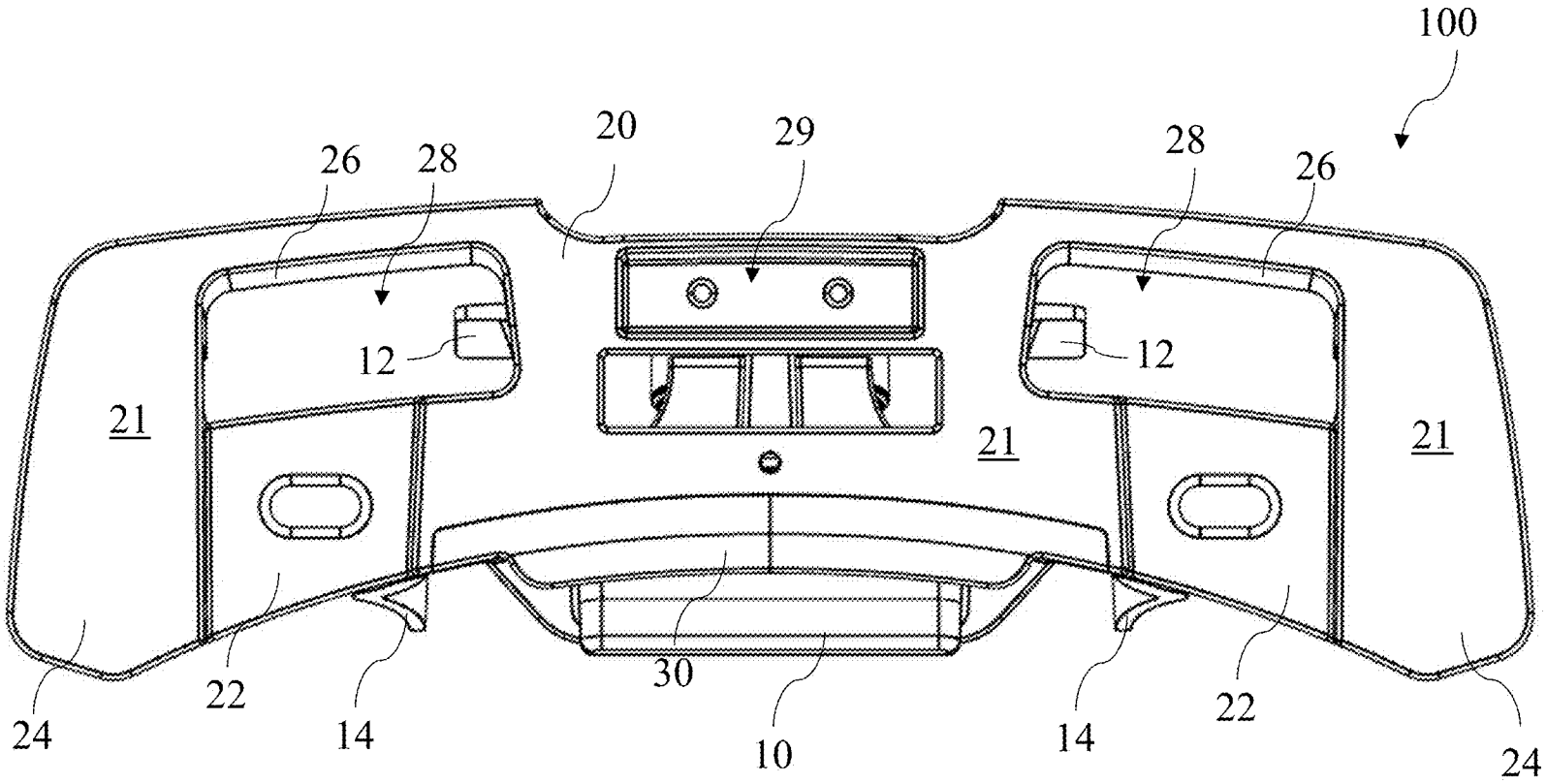
FIG. 4 illustrates a top view of the manifold of FIG. 1.

As illustrated in FIG. 3, the body 10 also includes a compartment 18. In some embodiments, the compartment 18 is watertight and houses wireless electricity transmission components. For example, the compartment 18 can house wireless electricity transmission components that power lights or other accessories of the selectively removable spa seatback. As also illustrated in FIG. 3, the platform 20 includes opposing brackets 26 that extend downwardly from the bottom surface 27 of the platform 20. As better seen in FIG. 4, illustrating a top view of the manifold 100, the top surface 21 of the platform, together with the opposing brackets 26, define or create voids 28.

The voids 28 are positioned on opposing sides of the top surface 21 of the platform 20. In some embodiments, the opposing brackets 26 extend downwardly from the voids 28, creating a back wall for the voids 28. A small piece of the clamp portion 12 is visible through each of the voids 28 in the top view shown in FIG. 4. As also illustrated in FIG. 4, the top surface 21 defines a central trough or trench 29 in substantially a center of the platform 20. In some embodiments, the voids 28 flank the central trough 29. The divots 22 for engaging a pillow are also clearly illustrated in FIG. 4 and are disposed in front of the voids 28.

The front perspective view of the manifold 100 of FIG. 1 shows each arm 11 of the pair of arms 11, as is the winged portion 14 of each arm 11. The pair of arms 11 can also be seen flanking or laterally disposed about the constraining plate 30. This configuration allows the constraining plate 30 to restrict or constrain a movement of the winged portions 14 of each arm 11. For example, the winged portions 14 are capable of flexing both laterally, away from the headrest manifold 100, and medially, towards the manifold 100 (and a center of the manifold 100). Placement of the constraining plate 30 between the pair of arms 11 restricts at least the medial flexing of the winged portions 14. This restriction of movement prevents the manifold 100 from being removed from the selectively removable spa seatback accidentally or undesirably.

As will be described in more detail below with respect to FIGS. 5A and 5B, the constraining plate 30 is slidably engaged with the body 10 and the platform 20 When the constraining plate 30 is removed, the medial flexing of the winged portion 14 is no longer restricted. That is, the winged portions 14 "regain" their full movement capacity when the constraining plate 30 is removed. The manifold 100 can then be removed from the selectively removable spa seatback. In this way, the manifold 100 selectively engages with the selectively removable spa seatback. In other embodiments, the constraining plate 30 can be engaged in another manner with the winged portions 14, such as snap-fit, etc.

The divots 22 for engaging with a pillow extend downwardly from the top surface 21 of the platform 20. In some embodiments, the divots 22 have the illustrated shape of a cup. Additionally, and/or alternatively, the divots 22 can have a different shape or configuration (such as a grooved configuration) that still allows the divots 22 to receive and/or secure components of a pillow.

Figure 5A:
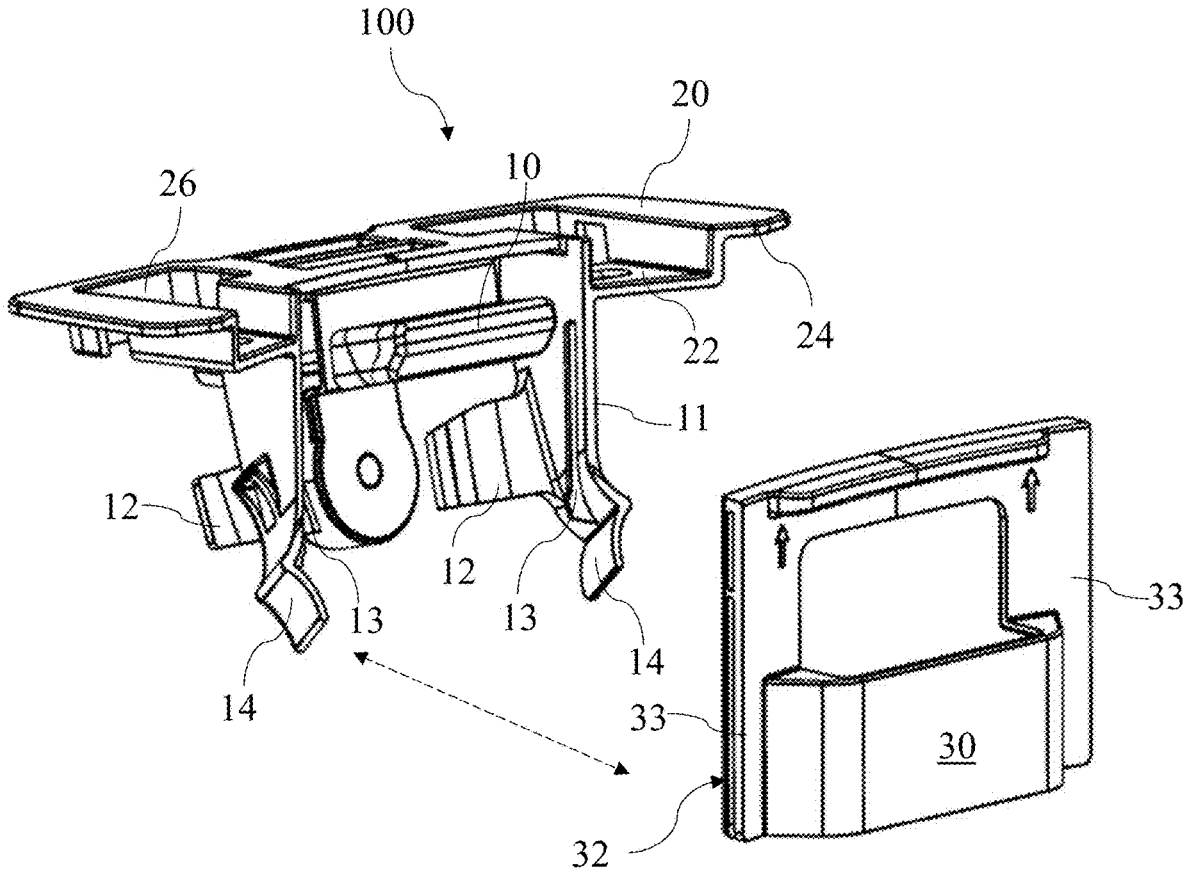
FIG. 5A illustrates an exploded view of the manifold of FIG. 1.
Figure 5B:
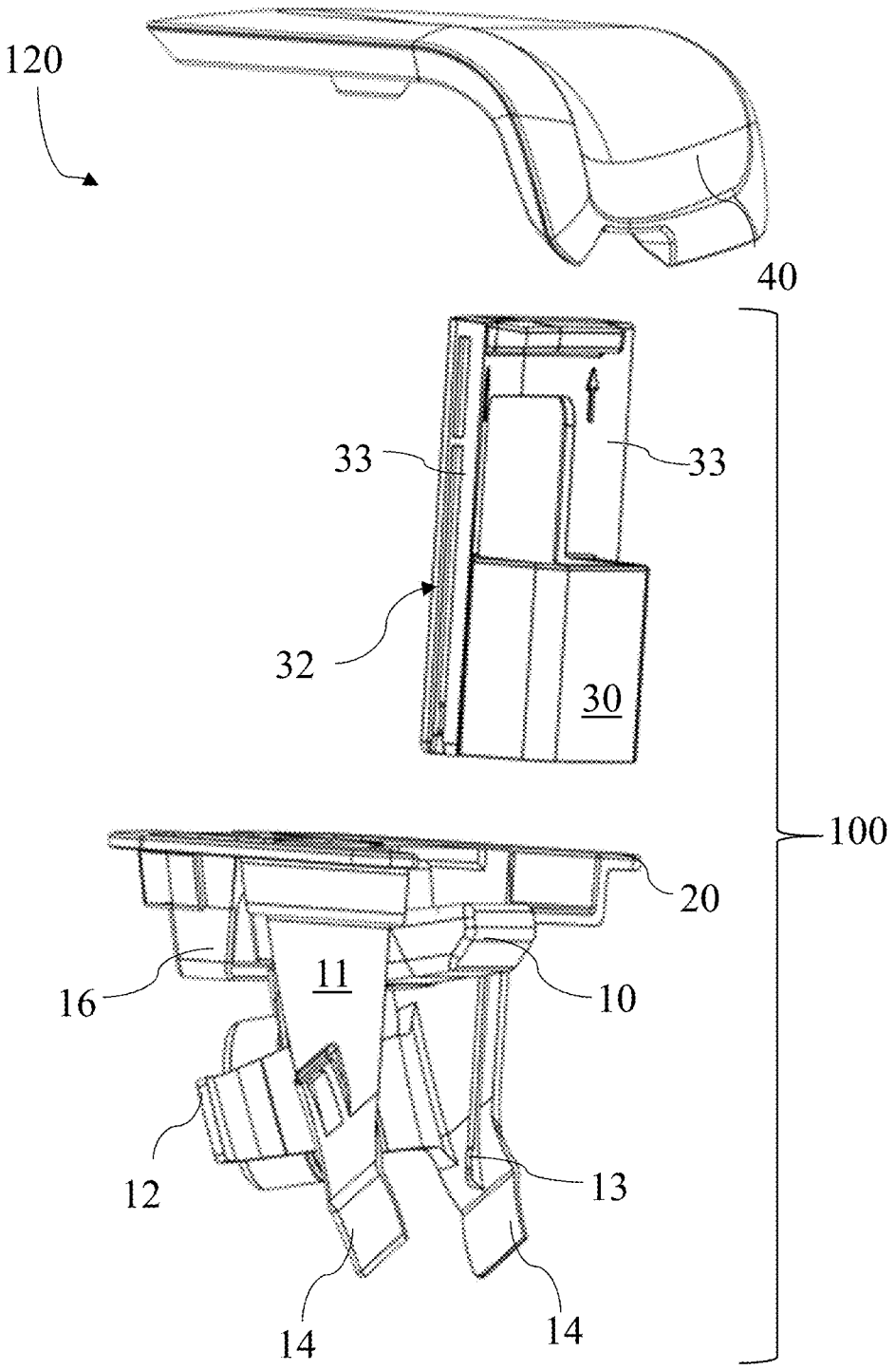
FIG. 5B illustrates an exploded view of a headrest including the manifold of FIG. 1 and a pillow.

FIG. 5A illustrates an exploded view of the manifold of FIG. 1 and FIG. 5B illustrates an exploded view of a headrest including the manifold of FIG. 1 and a pillow. As shown in FIG. 5A, the manifold 100 includes the body 10, the platform 20, and the constraining plate 30. A tab 13 is formed on a medial surface of each arm 11. The tab 13 on each arm 11 interacts with a slot 32 formed or defined by each lateral edge 33 of the constraining plate 30. In some embodiments, the tab 13 is an elongated tab, with a length matching or corresponding to a length of the slots 32. In some embodiments, the tab 13 is interrupted or includes a plurality of tabs 13 to slidably engage with the slots 32. In some embodiments, the constraining plate 30 includes a cut-out portion to accommodate portions of the body 10. In some embodiments, the constraining plate 30 includes orientation indicia (e.g., arrows or "this side up") to ensure the proper alignment and securement of the tabs 13 and the corresponding slots 32. In other embodiments, the constraining plate 30 is removably attached to or interacts with the manifold via friction-fit, snap-fit, etc.

The exploded view of FIG. 5B illustrates a headrest 120, including the manifold 100 and a pillow 40. The manifold 100 includes the body 10, the platform 20, and the constraining plate 30. The platform 20 (e.g., the top surface 21 of the platform 20) receives the pillow 40. One tab 13 is visible and is shown as extending from the body 10 to the winged portion 14 of an arm 11. Both tabs 13 slidably engage with the constraining plate 30 through the slots 32 formed on opposing edges 33 of the constraining plate 30. The engagement of the constraining plate 30 by the tabs 13 positions the constraining plate 30 between the pair of arms 11. In this way, the constraining plate 30 is positioned to constrain or restrict at least a medial flexing of the winged portions 14.

Figure 6:
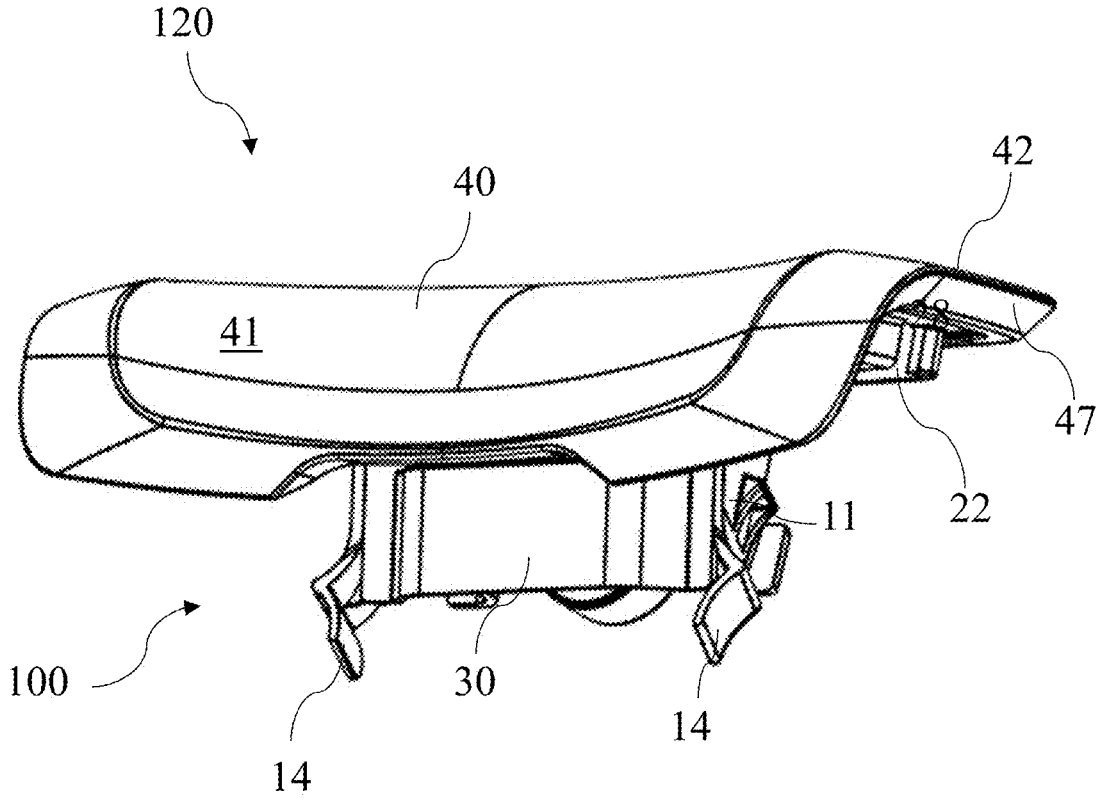
FIG. 6 illustrates a front perspective view of one embodiment of a headrest, according to embodiments of the present disclosure.

With reference now to FIG. 6, an embodiment of a headrest assembly 120 is shown and includes a pillow 40 selectively engaging the headrest manifold 100 shown in FIGS. 1-5A. FIG. 6 illustrates a front perspective view of one embodiment of a headrest 120. As illustrated, the headrest 120 includes a pillow 40 disposed on or received by the manifold 100. The pillow 40 includes a flat portion 42 that is received by the manifold 100 and a curved portion 41. In some embodiments, the curved portion 41 overhangs the manifold 100, leaving a gap between the manifold 100 and an inner surface of the pillow 40 (see gap 43 in FIGS. 7 and 11).

Figure 7:
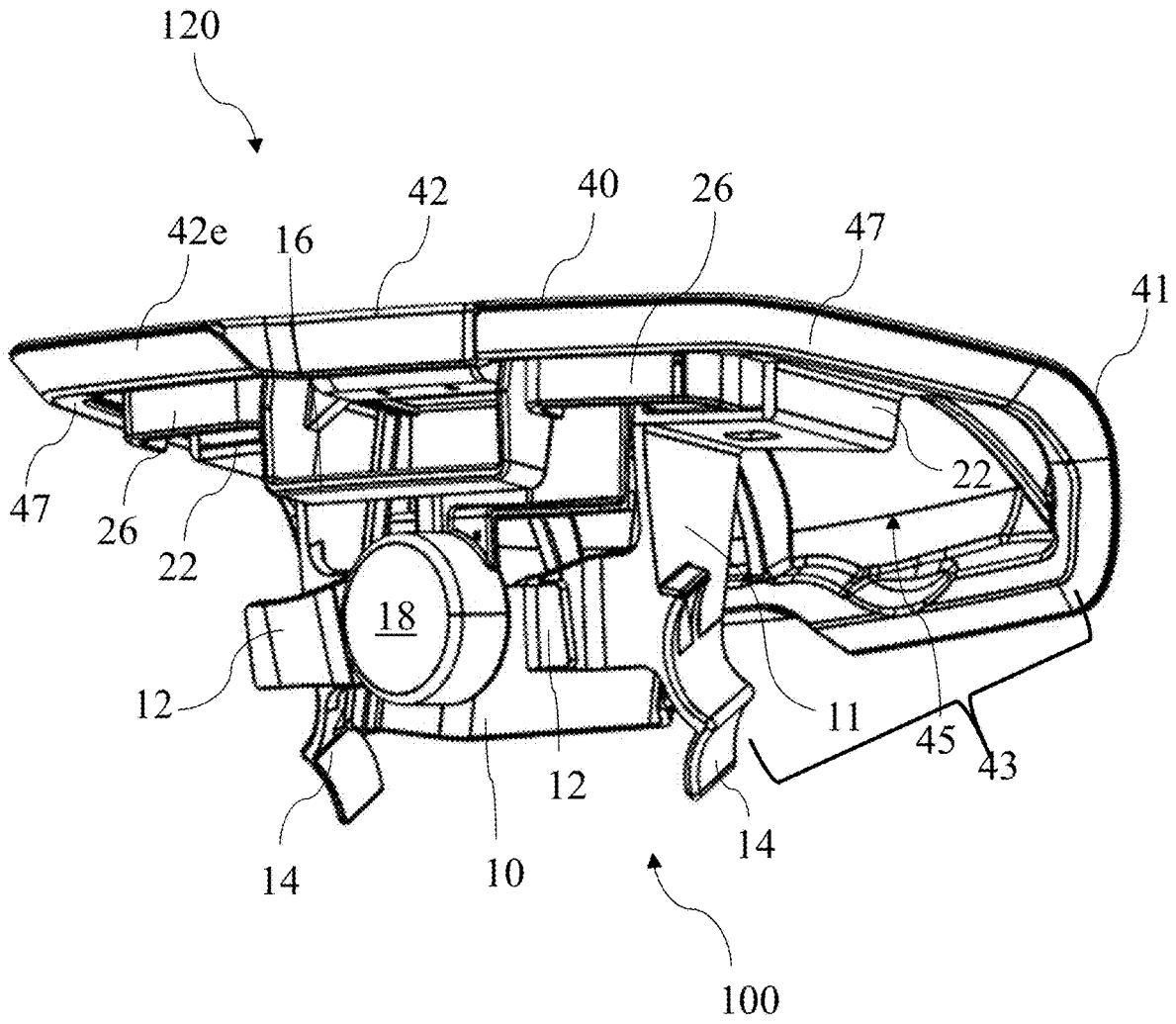
FIG. 7 illustrates a back perspective view of the headrest of FIG. 6.

FIG. 7 illustrates a back perspective view of the headrest 120 of FIG. 6. The headrest 120 includes the pillow 40 disposed on the manifold 100. Specifically, portions of the pillow 40 are received by the divots 22 disposed on opposing sides of the platform 20. The flat portion 42 of the pillow 40 is disposed over both the opposing divots 22 and the opposing brackets 26. As illustrated, the opposing brackets 26 substantially align with a back edge 42*e* of the flat portion 42. In this embodiment, a handle 16 of the manifold 100 can be seen disposed between the opposing brackets 26. In other embodiments, a handle is not provided.

The gap 43 between an inner surface 45 of the pillow 40 and the manifold 100 is clearly illustrated. Specifically, the gap 43 is disposed or otherwise formed between the inner surface 45 of the curved portion 41 of the pillow 40 and the arms 11 of the body 10. Both the clamp portions 12 and the winged portions 14 are clearly illustrated in FIG. 7. The compartment 18 is also visible.

Figure 8:
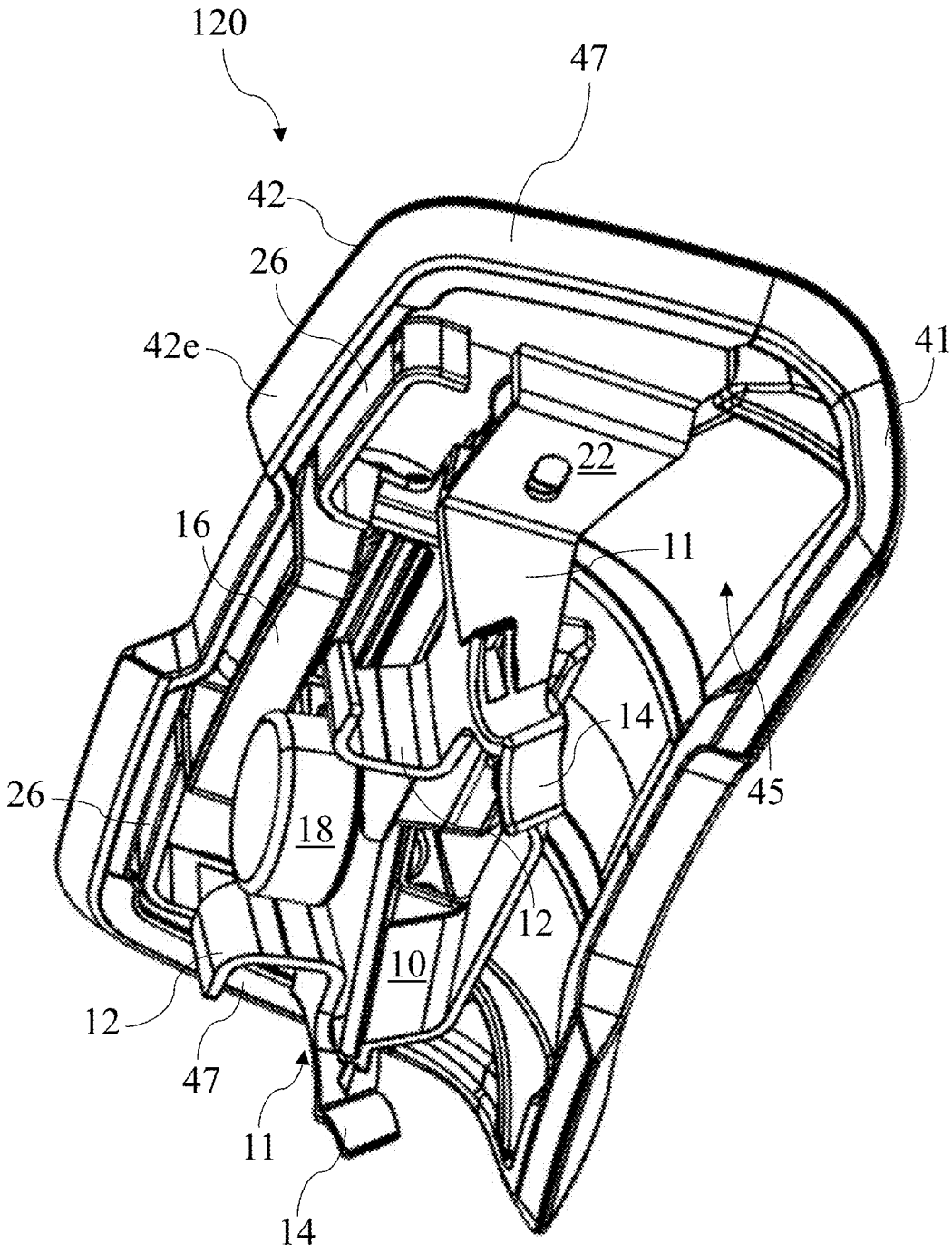
FIG. 8 illustrates a bottom perspective view of the headrest of FIG. 6.

FIG. 8 illustrates a bottom perspective view of the headrest 120 of FIG. 6. As illustrated, the opposing brackets 26 that extend downwardly from a bottom side of the platform 20 substantially align with the back edge 42*e* of the pillow 40. The handle 16 is also visible. The divots 22 are illustrated as receiving a portion of the pillow 40, described in more detail below.

Figure 9:
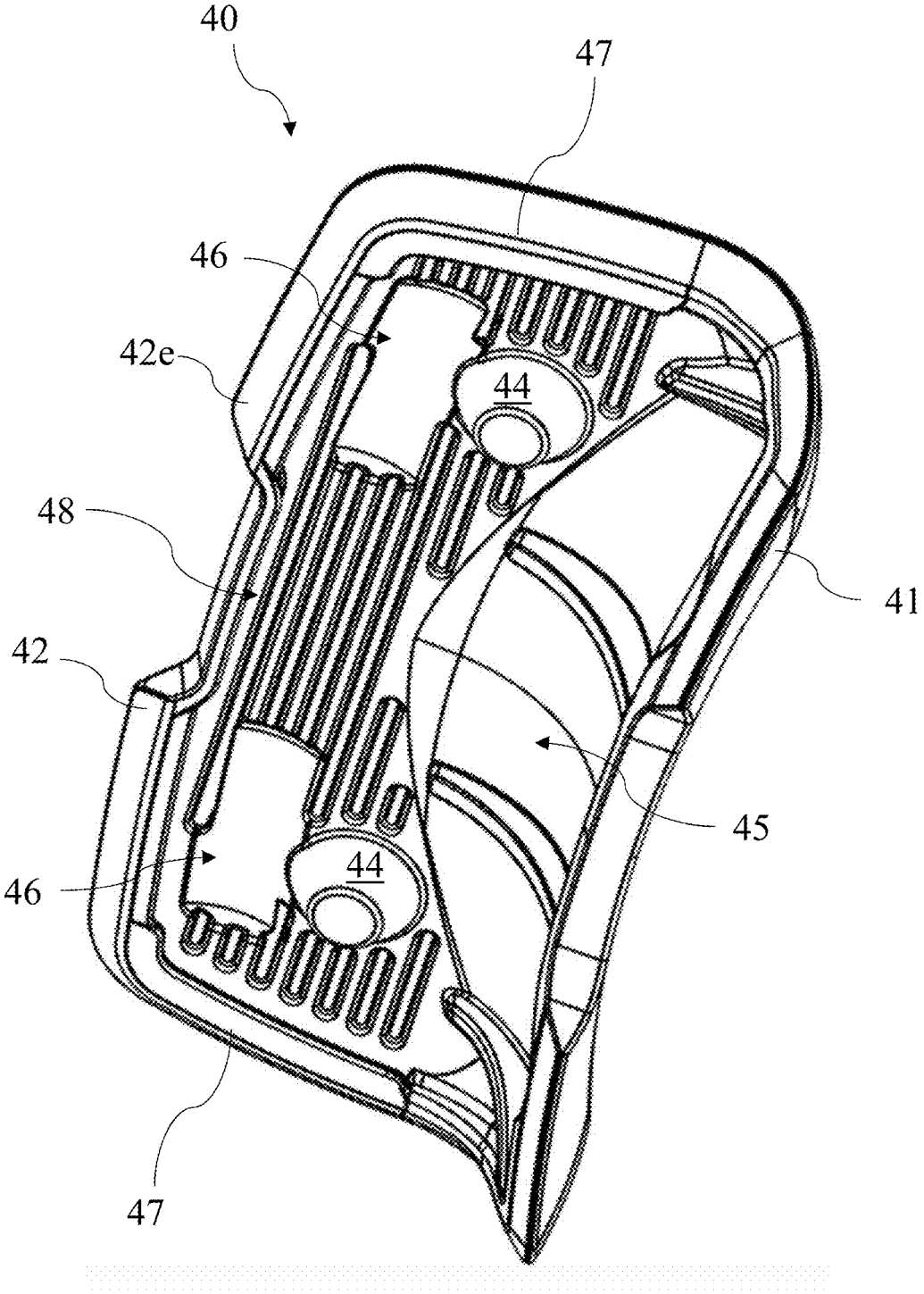
FIG. 9 illustrates a bottom perspective view of a pillow, according to embodiments of the present disclosure.

FIG. 9 illustrates a bottom perspective view of a pillow 40 according to embodiments of the present disclosure. As illustrated, the pillow 40 includes a flat portion 42 with a back edge 42*e*, a curved portion 41, an inner surface 45 including a plurality of grooves 48 and defining opposing furrows 46, and protrusions 44. In some embodiments, the protrusions 44 are for engaging the divots 22. Accordingly, the positioning of the protrusions 44 (which are illustrated as opposing protrusions 44) of the pillow 40 substantially aligns with the placement of the divots 22 within the platform 20. In some embodiments, such as illustrated, the protrusions 44 are conical in shape. In some embodiments, the protrusions 44 can be a square or other shape to fit, engage, and/or sit within the divots 22. In some embodiments, the furrows 46 substantially align with the voids 28 defined in the top surface 21 of the platform 20.

Figure 10:
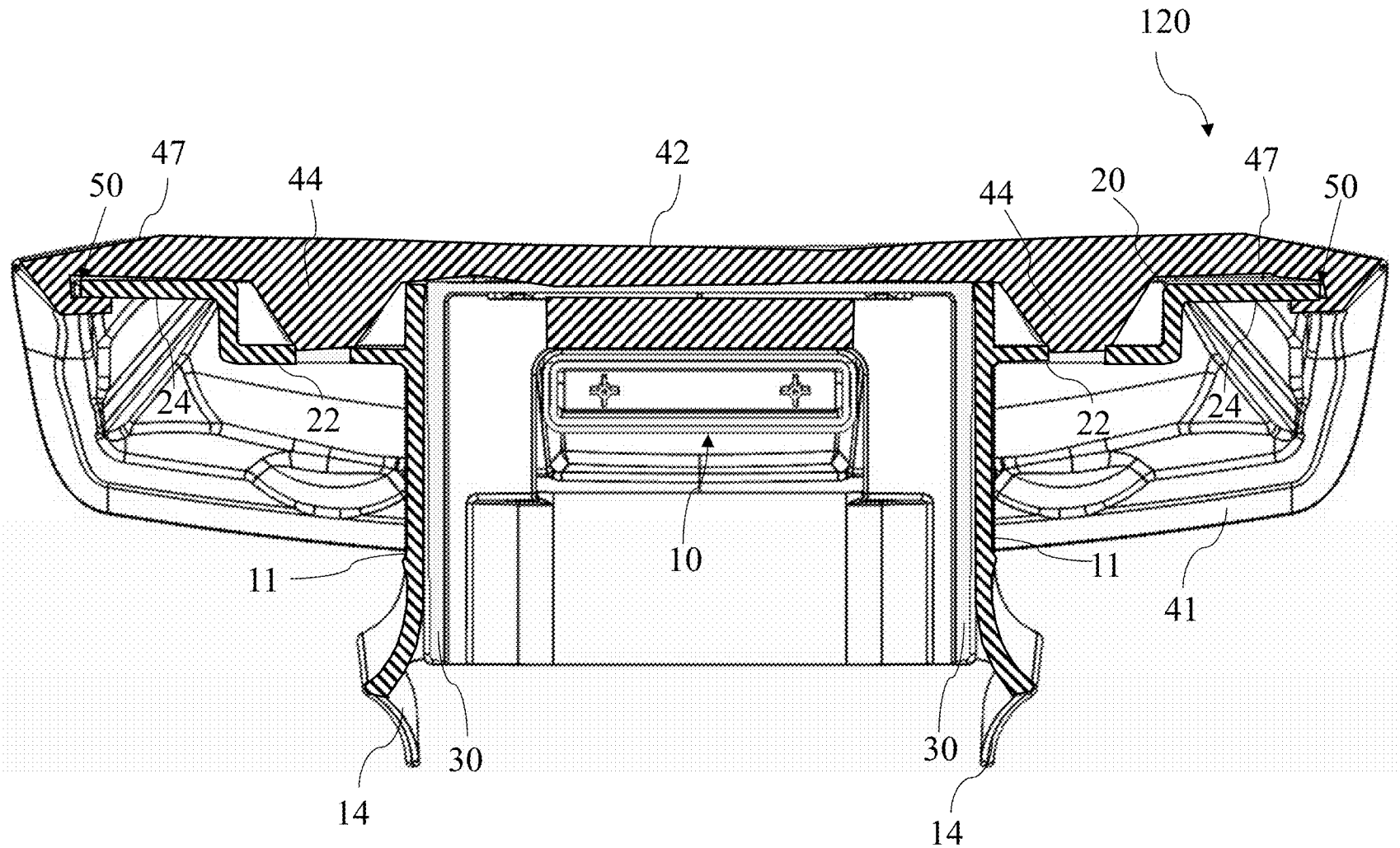
FIG. 10 illustrates a back cross-sectional view of the headrest of FIG. 6.

FIG. 10 illustrates a back cross-sectional view of the headrest 120 of FIG. 6. As illustrated, the headrest 120 includes the pillow 40 disposed on the platform 20 of the manifold 100, where the manifold 100 additionally includes the body 10 and the constraining plate 30. The opposing protrusions 44 of the pillow 40 are clearly received by the opposing divots 22 of the platform 20. In some embodiments, the protrusions 44 extend downwardly and are integrated with the flat portion 42 of the pillow 40. In some embodiments, another point of attachment between the pillow 40 and the platform 20 of the manifold 100 includes slots 50 within the edges 47 of the pillow 40, the slots 50 receiving the overhangs 24 of the platform 20.

Figure 11:
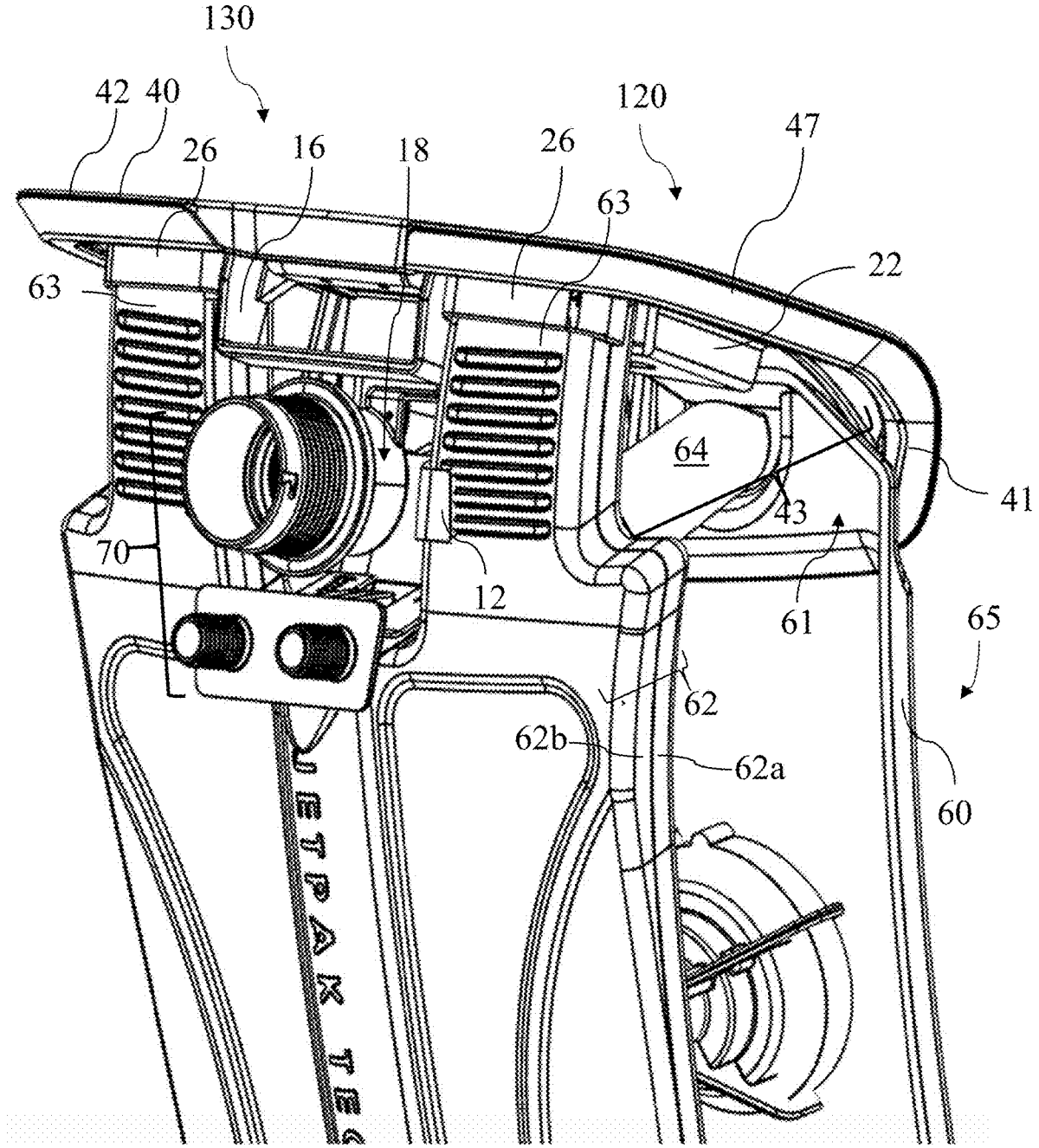
FIG. 11 illustrates a back perspective view of a headrest inserted into a selectively removable spa seatback, according to embodiments of the present disclosure.

FIG. 11 illustrates a back perspective view of an assembled selectively removable spa seatback 130 according to embodiments of the present disclosure. In some embodiments, the assembled selectively removable spa seatback 130 includes a headrest 120, such as the headrest 120 of FIGS. 6-10, and a selectively removable spa seatback 65. The selectively removable spa seatback 65 can include a front plate 60 with a top portion 61 and a back manifold 62. In some embodiments, the back manifold 62 includes two pieces, such as a front half 62*a* including a crossbar 64 and a back half 62*b*. In some embodiments, the back half 62*b* includes indicia or other markings, which may be trademarks or orientation indicia (e.g., "this side up"). In some embodiments, the assembled selectively removable spa seatback 130 additionally includes one or more nozzles 70 to allow for hookups to additional accessories and/or insertion of the assembled selectively removable spa seatback 130 into a spa.

As can be seen in FIG. 11, portions of the headrest manifold 100 engage with, interact with, and/or secure to portions of the selectively removable spa seatback 65. For example, a part of one clamp portion 12 can be seen engaging top wings 63 of the back manifold 62 of the selectively removable spa seatback 65. In some embodiments, the clamp portions 12 slidably receive the top wings 63 of the back manifold 62. Additionally, and/or alternatively, in some embodiments the top wings 63 "click-in" to the clamp portions 12. For example, grooves or other workings on the top wings 63 may interact with protrusions or other workings on the clamp portions 12, such that the paired or corresponding grooves/protrusions or other workings snap together.

As can also be seen in FIG. 11, the opposing brackets 26 that extend downwardly from a bottom surface of the platform 20 also engage or otherwise interact with the top wings 63 of the back manifold 62. Similar to the engagement by the clamp portions 12, in some embodiments, the opposing brackets 26 slidably receive the top wings 63 of the back manifold 62. In some embodiments the top wings 63 "click-in" to the opposing brackets 26 or are otherwise received within the opposing brackets 26. Each clamp portion 12 of each arm 11 is substantially aligned with a corresponding opposing bracket 26. That is, a first clamp portion 12 is aligned with a first opposing bracket 26, such that a first top wing 63 of the selectively removable spa seatback 65 is engaged by both the first clamp portion 12 and the first opposing bracket 26. In some embodiments, the top wings 63 may have an angled configuration. In such cases, the first clamp portion 12 and the first opposing bracket 26 may be slightly offset along a vertical axis of the back manifold 62 to accommodate for the angled configuration of the top wings 63. It is to be understood that the same alignment and/or slight offset along the vertical axis is applicable to the second clamp portion 12 and the second opposing bracket 26.

Figure 13:
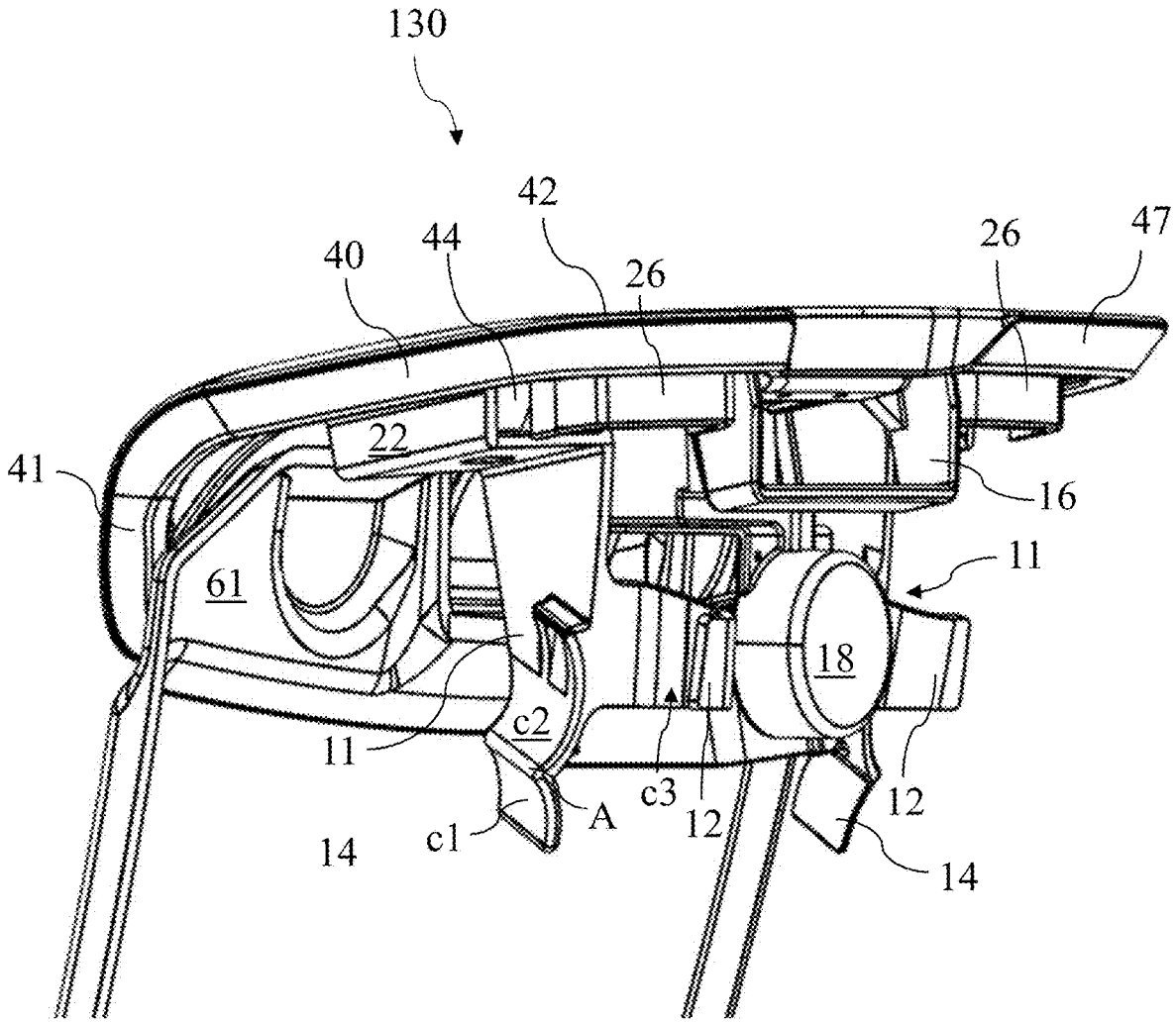
FIG. 13 illustrates a back perspective view of the headrest and selectively removable spa seatback assembly of FIG. 11.

Though not visible in FIG. 11, the winged portions 14 of the arms 11 of the body 10 engage and/or interact with the crossbars 64 of the front half 62*a* of the back manifold 62 of the selectively removable spa seatback 65. Referring briefly to FIG. 13, illustrating a back perspective view of the assembled selectively removable spa seatback 130, the winged portions 14 can have a curled or curved arrangement or shape. As illustrated in FIG. 13, the winged portions 14 include two curves c1, c2 joined at an apex A. A radius or diameter of, at least, c2 can correspond to a radius or diameter of the crossbars 64 that the winged portions 14 engage or interact with.

Referring back to FIG. 11, the crossbars 64 extend from the front half 62*a* of the back manifold 62 to a top portion 61 of the front plate 60 of the selectively removable spa seatback 65. In some embodiments, the crossbars 64 bridge the gap 43 disposed between an inner surface 45 of the curved portion 41 of the pillow 40 and the manifold 100. In some embodiments, the crossbars 64 are adjacent to the winged portions 14. In some embodiments, the crossbars 64 are secured by the winged portions 14, such as by clicking into or being clamped by at least curve c2 (FIG. 13) of the winged portions 14.

Though not visible in FIG. 11, the clamp portions 12 and the winged portions 14 engage the selectively removable spa seatback 65 (e.g., components of) orthogonally to each other. Referring to FIG. 13, the engagement portions of the clamp portions 12 and the winged portions 14 are oriented orthogonally (i.e., perpendicularly or normally) to each other. As can be seen, the clamp portions 12 also include a curve c3. The curves c1 and c2 of the winged portions 14 are oriented in a plane normal to a plane of curve c3 the clamp portions 12. This orientation results in the clamp portions 12 and the winged portions 14 engaging the selectively removable spa seatback 65 (e.g., components of) orthogonally to each other. That is, the clamp portions 12 engage a portion of the selectively removable spa seatback 65 in a vertical orientation (for example, slidably up/down), and the winged portions 14 engage a portion of the selectively removable spa seatback in a horizontal orientation (front to back). This combination of orthogonal engagements can result in a desired level of engagement to ensure the headrest does not disengage from the selectively removable seatback undesirably.

The divots 22 of the manifold 100 (i.e., of the platform 20) can be seen receiving the pillow 40. As can be seen in FIG. 13, one of the protrusions 44 of the pillow 40 is received by or disposed with a corresponding divot 22. The handle 16, disposed between the opposing brackets 26, is clearly illustrated in FIGS. 11 and 13.

Figure 12:
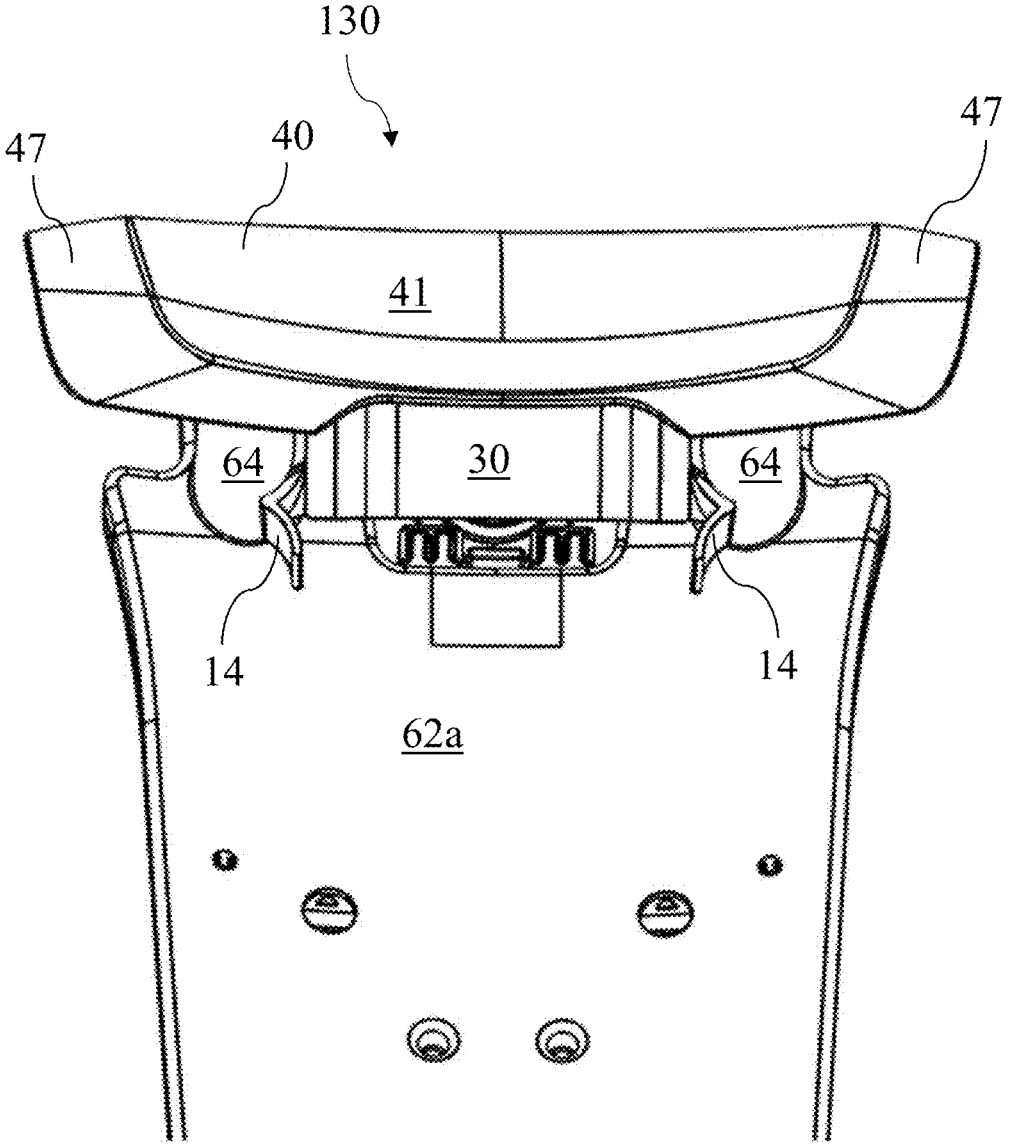
FIG. 12 illustrates a front view of the headrest and selectively removable spa seatback assembly of FIG. 11.

FIG. 12 illustrates a front view of the headrest and selectively removable spa seatback assembly 130 of FIG. 11. The front plate 60 has been removed for clarity. The interaction or engagement of the crossbars 64 by the winged portions 14 is clearly illustrated.

Figure 14:
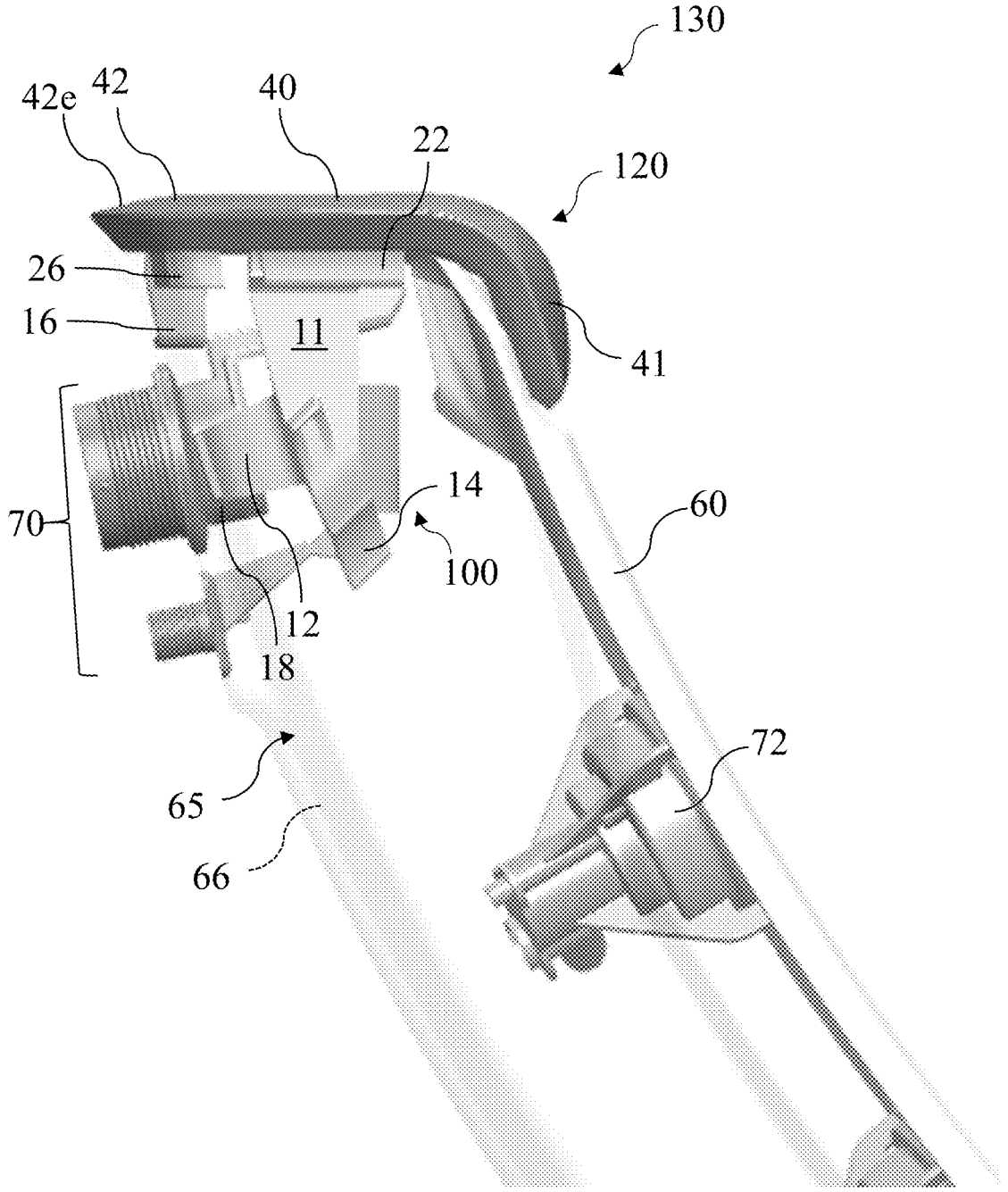
FIG. 14 illustrates a side view of the headrest and selectively removable spa seatback assembly of FIG. 11.

FIG. 14 illustrates a side view of the headrest and selectively removable spa seatback assembly 130 of FIG. 11. In some embodiments, the selectively removable spa seatback 65 additionally includes a casing 66 that surrounds the assembled selectively removable spa seatback 130. In some embodiments, the casing 66 is disposed adjacent to the back manifold 62 of the selectively removable spa seatback 65. The casing 66 has been illustrated in phantom, so the internal interactions between the selectively removable spa seatback 65 and the headrest 120 can be seen. The back manifold 62 is not shown to more clearly illustrate the manifold 100 disposed within the selectively removable spa seatback 65.

As illustrated, the assembled selectively removable spa seatback 130 includes the headrest 120 (with the manifold 100 and the pillow 40) and the selectively removable spa seatback 65. The curved portion 41 of the pillow can be seen covering at least a portion (e.g., a top portion) of the front plate 60 of the selectively removable spa seatback 65. One arm 11 of the pair of arms 11, with its clamp portion 12 and winged portion 14, can clearly be seen. In some embodiments, the entire manifold 100 is received within the casing 66. In some embodiments, a portion of the manifold 100 is received within the casing 66. For example, the handle 16 may be outside the casing 66.

In some embodiments, the manifold 100 selectively engages a selectively removable spa seatback 65. In some embodiments, the manifold 100 only engages selectively removable spa seatback 65 and does not engage with any components of a spa. For example, when the assembled selectively removable spa seatback 130 is inserted into a spa, the casing 66 of the assembled selectively removable spa seatback 130 can be the only component that interacts or interfaces with the spa. In some embodiments, the spa includes a plurality of cavities or seating positions sized and shaped to receive the assembled selectively removable spa seatback 130.

For example, the plurality of seating positions may be sized and shaped to correspond to a size and shape of the casing 66, where the components of the assembled selectively removable spa seatback 130 are housed or contained within the casing 66 (e.g., fully housed within the casing 66). In some embodiments, the manifold 100 (e.g., components of the manifold 100) only engages the selectively removable spa seatback 65 and/or components of the selectively removable spa seatback 65. In some embodiments, a back edge 42*e* of the flat portion 42 of the pillow 40 may rest on a surface of a spa. Otherwise, in some embodiments, no components of the assembled selectively removable spa seatback 130 engage or interact with the spa where the assembled selectively removable spa seatback 130 has been inserted.

In some embodiments, the casing 66 defines holes to receive one or more nozzles 70. In some embodiments, holes defined by the casing 66 to receive the one or more nozzles 70 may substantially align with the compartment 18 of the manifold 100. Such alignment may permit the wireless transmission of electricity to components housed, for example, within the compartment 18. In some embodiments, the assembled selectively removable spa seatback 130 further includes one or more jets 72. The one or more jets 72 may be disposed or otherwise received by the front plate 60 of the selectively removable spa seatback 65.

Figure 15:
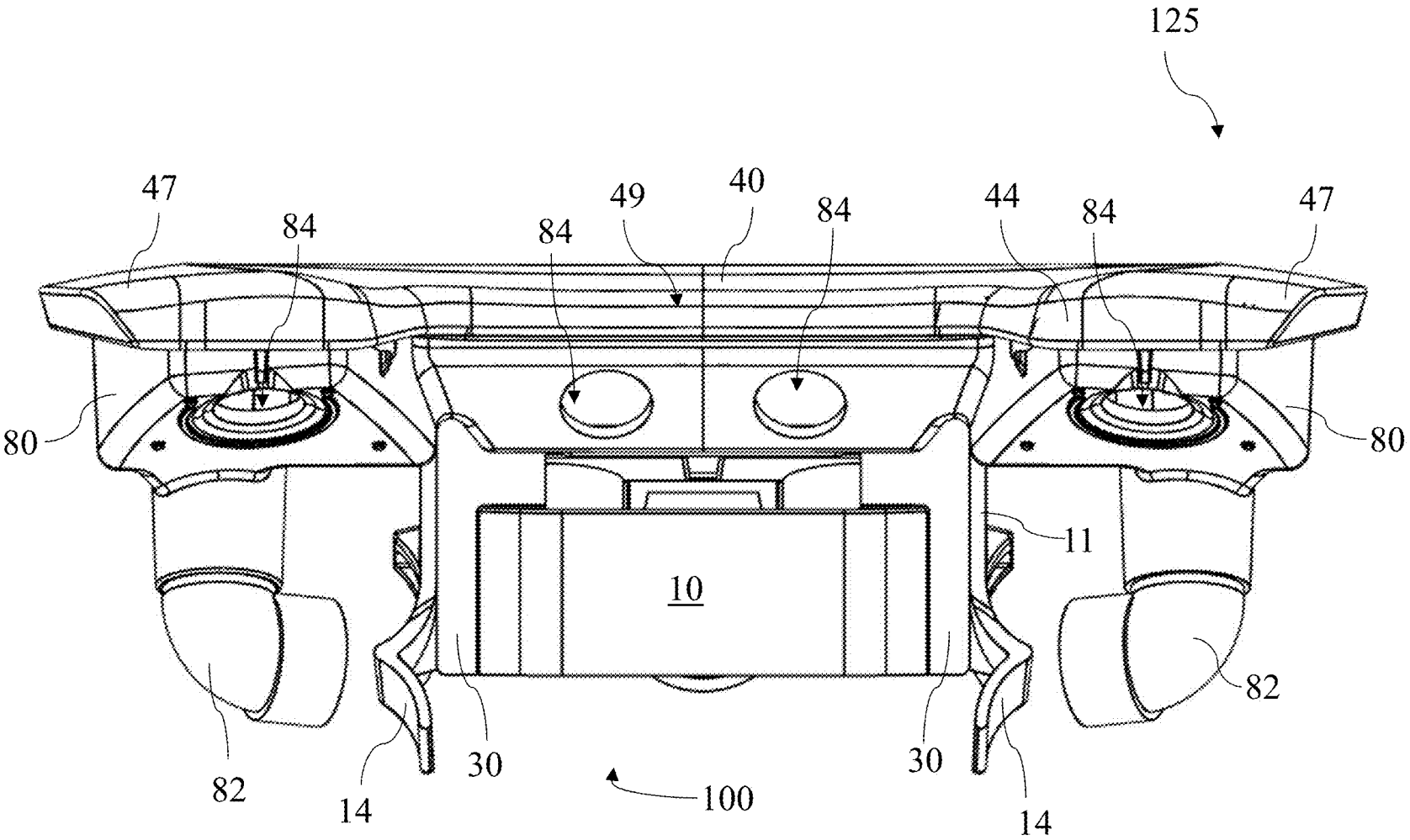
FIG. 15 illustrates a front view of another embodiment of a headrest, according to embodiments of the present disclosure.

FIG. 15 illustrates another embodiment of a headrest 125, according to embodiments of the present disclosure. The disclosure and discussion relating to the manifold 100 of FIGS. 1-5 and the headrest 120 of FIGS. 6-10 is applicable and relevant to the headrest 125 of FIGS. 15-17, so like elements will be labeled with like reference numerals. As illustrated, the headrest 125 includes a manifold 100 having a platform 20 (not visible in FIG. 15), a body 10, and a constraining plate 30. The headrest 125 additionally includes a canister 80, which may be referred to as a "neck canister" 80, and a pillow 40. In the illustrated embodiment of the headrest 125, the pillow 40 includes or defines a cut-out 49, which may accommodate a neck of a user of the headrest 125. The cut-out 49 can be included or defined by the curved portion 41 of the pillow 40. The cut-out 49 may impart a profile to the pillow 40, where the profile is substantially U-shaped. In some embodiments, the canister 80 has a corresponding profile that matches the profile of the pillow 40 and is, likewise, substantially U-shaped.

In some embodiments, such as that illustrated in FIG. 15, the canister 80 includes a plurality of jets or orifices 84 positioned and disposed throughout the canister 80. The canister 80 can additionally include piping extensions 82. In some embodiments, the piping extensions 82 include fittings for PVC pipes or connectors. In some embodiments, the piping extensions 82 place the headrest 125 and/or the canister 80 in fluid communication with a water source. Additionally, and/or alternatively, the piping extensions 82 place the headrest 125 and/or the canister 80 in fluid communication with a spa, such that water can flow through the piping extensions 82 and through the plurality of jets 84 to, for example, massage the neck of a user of the headrest 125.

As before, the constraining plate 30 is positioned such that it is flanked or laterally sandwiched between the pair of arms 11. Each arm 11 of the pair of arms 11 includes a clamp portion 12 (not visible in FIG. 15) and a winged portion 14. The constraining plate 30 is again positioned such that it restricts a movement of the winged portion 14, such as medial flexing of the winged portion 14.

Figure 16:
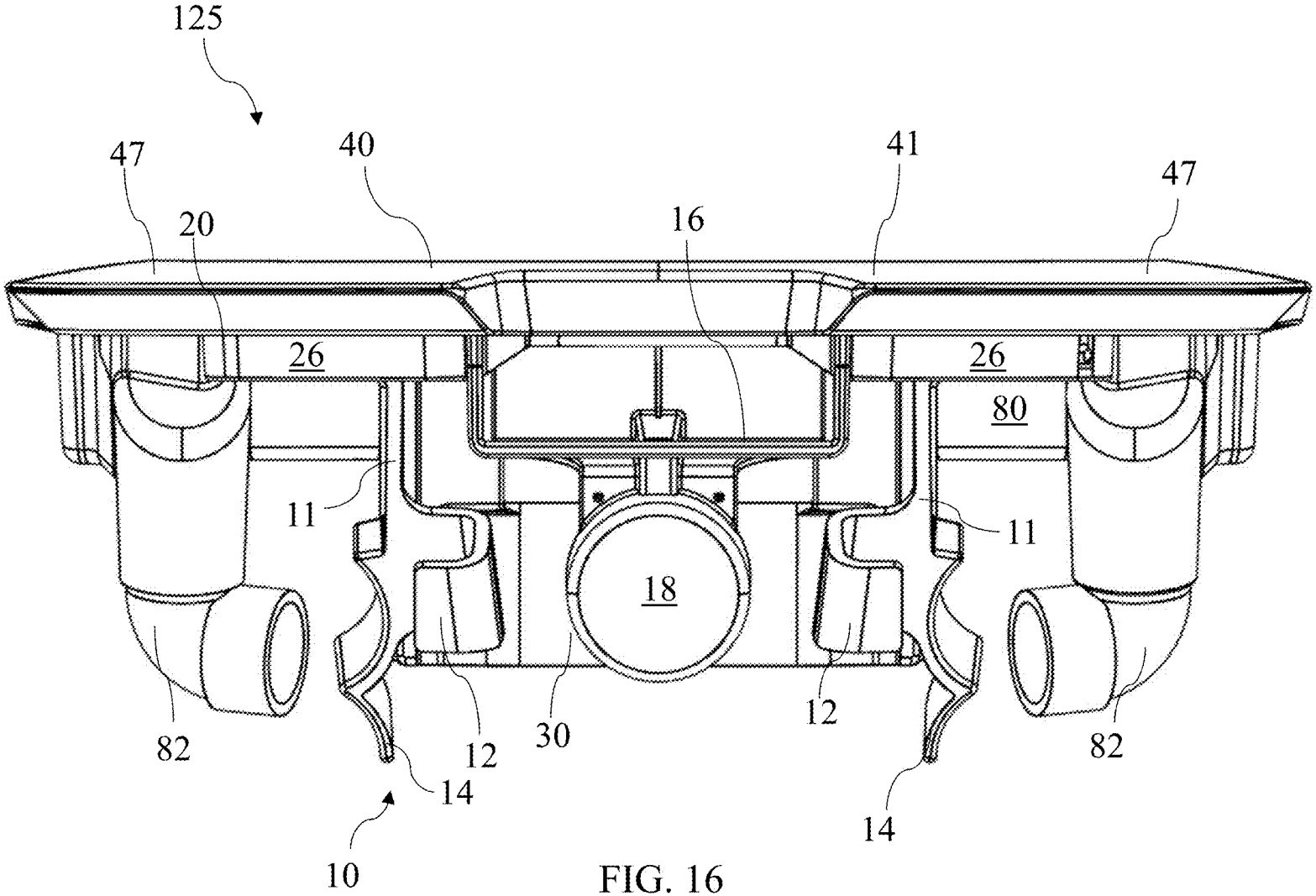
FIG. 16 illustrates a back view of the headrest of FIG. 15.
Figure 17:
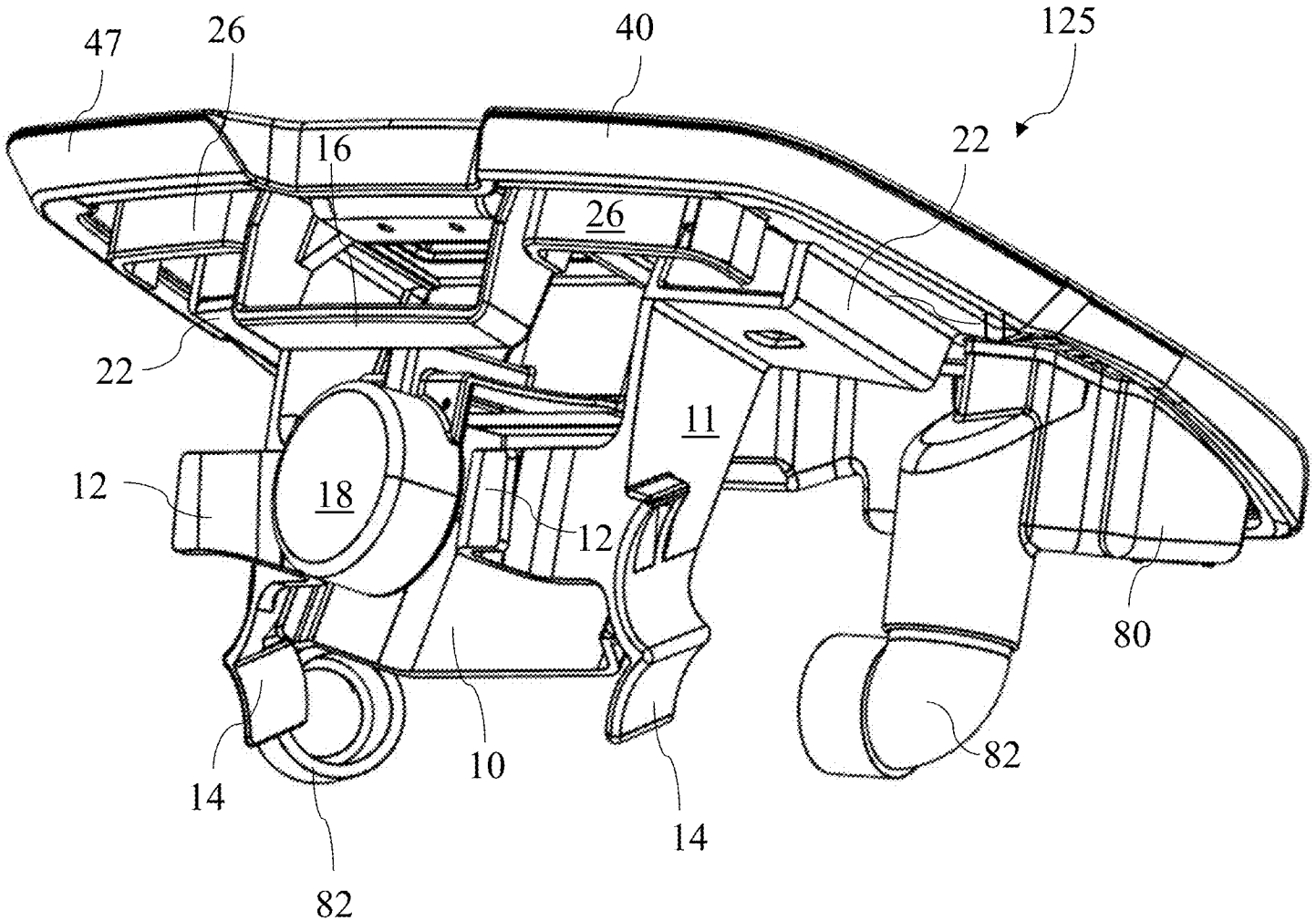
FIG. 17 illustrates a bottom perspective view of the headrest of FIG. 15.

FIG. 16 illustrates a back view and FIG. 17 illustrates a bottom perspective view of the headrest 125 of FIG. 15, where components of the platform 20 and the body 10 are more clearly illustrated. As with the manifold 100 of FIGS. 1-5 and the headrest 120 of FIGS. 6-10, the platform 20 receives the pillow 40. For example, though not illustrated, the platform 20 includes or defines divots 22, such as the opposing divots 22 illustrated in FIG. 1. The divots 22 can receive a portion of the pillow 40 (such as protrusions 44 in FIG. 9) to secure the pillow 40 to the manifold 100 and the platform 20. As described previously, edges 47 of the pillow 40 can interact with portions of the platform 20 to further secure the pillow 40 to the platform 20.

As shown in FIGS. 16 and 17, the body 10 includes the pair of arms 11 which, in some embodiments, flank or otherwise interface with the constraining plate 30. In some embodiments, the constraining plate 30 is received by the body 10. For example, briefly referring to FIGS. 5A and 5B, the arms 11 of the body 10 may include tabs 13 on a medial or internal surface of the arms 11 that engage with slots 32 of the constraining plate 30. The constraining plate 30 can be disposed over the tabs 13 and may be disposed adjacent or next to a front edge of the platform 20. In some embodiments, the constraining plate 30 is received by tabs 13 formed by the body 10. In some embodiments, the constraining plate 30 is received by tabs formed or defined by the body 10 and/or the platform 20.

Like the manifold 100 and body 10 of FIGS. 1-5, each arm 11 of the pair of arms 11 includes a clamp portion 12 and a winged portion 14, where the clamp and winged portions 12, 14 are oriented orthogonally (i.e., perpendicularly) to each other. The clamp and winged portions 12, 14 engage or otherwise secure a selectively removable spa seatback to the manifold 100 and the headrest 125. In some embodiments, the clamp portion 12 engages or otherwise secures the selectively removable spa seatback in an orientation perpendicular to the engagement of the selectively removable spa seatback by the winged portion 14.

The body 10 also includes the compartment 18. In some embodiments, the compartment 18 is watertight and houses wireless electricity transmission components. As also illustrated, the platform 20 includes opposing brackets 26 that extend downwardly from a bottom surface of the platform 20 (see bottom surface 27 in FIGS. 1-3). The divots 22 of the platform are most clearly illustrated in FIG. 17. As before, the divots 22 receive portions of the pillow 40 (e.g., the protrusions 44) to secure the pillow 40 to the platform 20. A handle 16 is disposed between the opposing brackets 26. In some embodiments, the handle 16 extends downwardly from the bottom surface of the platform 20.

Also disclosed are methods of connecting a headrest to a spa, such as a hot tub. In some embodiments, methods include selecting a headrest, attaching the headrest to a selectively removable spa seatback, and inserting the selectively removable spa seatback with the attached headrest to the spa. In some embodiments, methods include selecting a headrest, engaging a front plate of a selectively removable spa seatback, engaging top wings of a back manifold of the selectively removable spa seatback, and inserting the selectively removable spa seatback with the attached headrest to the spa.

Figure 18:
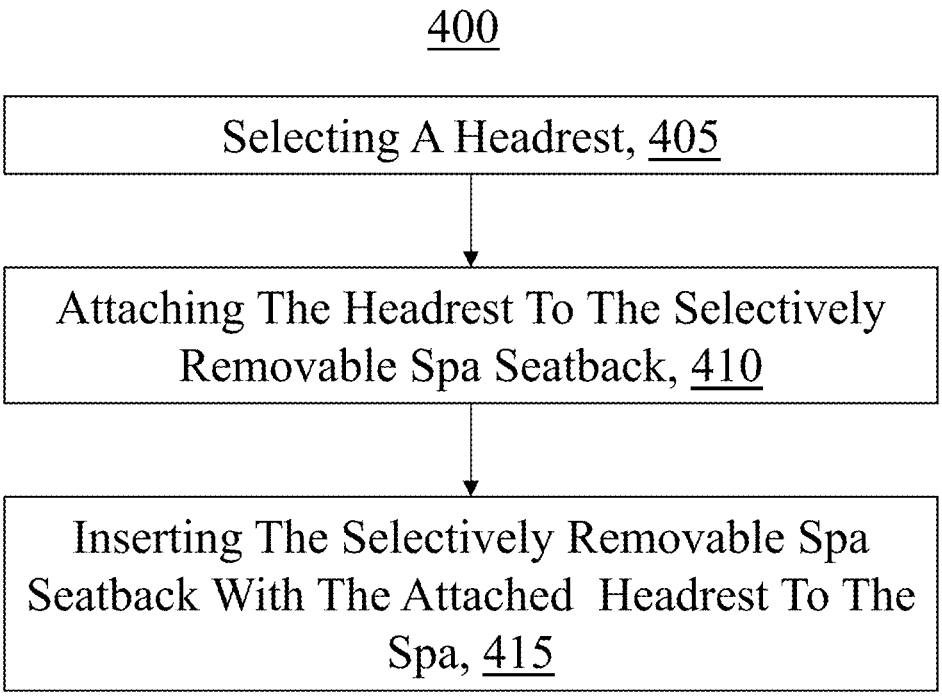
FIGS. 18 and 19 illustrate flowcharts of methods, according to embodiments of the present disclosure.
Figure 19:
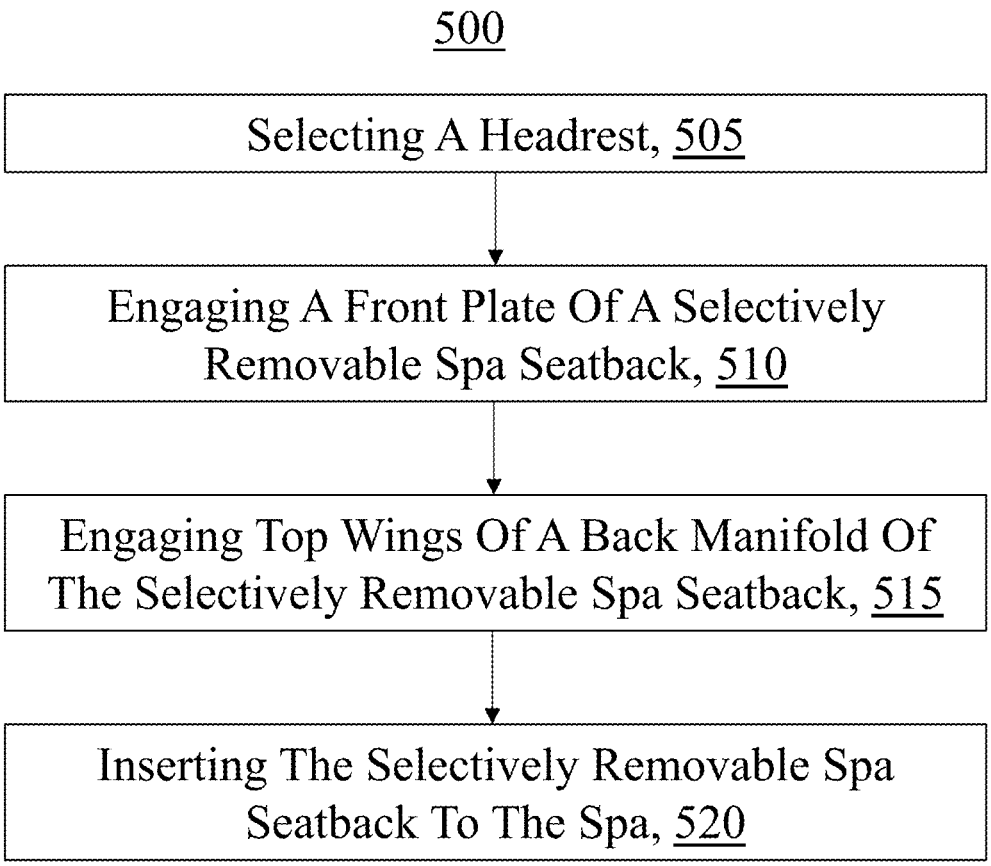

FIGS. 18 and 19 illustrate flowcharts of methods, according to embodiments of the present disclosure. FIG. 18 illustrates a method 400 of attaching a headrest, such as the headrests of FIGS. 6-17, to a spa. In some embodiments, the method 400 includes selecting a headrest, at 405. In some embodiments, the headrest includes a pillow, and a manifold to (a) receive the pillow and (b) to selectively engage a selectively removable spa seatback. The method 400 can also include attaching the headrest to the selectively removable spa seatback, at 410. In some embodiments, attaching the headrest to the selectively removable spa seatback includes engaging a front plate and/or a back manifold of the selectively removable spa seatback by one or more components of the manifold and/or the pillow.

For example, in some embodiments, the pillow includes a flat portion and a curved portion, where the curved portion engages or otherwise interfaces with at least a portion of a top of the front plate of the selectively removable spa seatback. In some embodiments, attaching the headrest to the selectively removable spa seatback also includes engaging a back manifold of the selectively removable spa seatback by the headrest manifold. For example, one or more components of the headrest manifold can selectively engage or otherwise interface with the back manifold of the selectively removable spa seatback.

In some embodiments, the method 400 further includes inserting the selectively removable spa seatback with the attached headrest into a spa, at 415. For example, the assembled selectively removable spa seatback and headrest can be inserted into a position within the spa corresponding to a seat. Inserting the selectively removable spa seatback with the attached headrest can includes positioning a casing of the assembled selectively removable spa seatback adjacent to the position within the spa. In some embodiments, the method 400 can include inserting more than one assembled selectively removable spa seatback and headrest into the spa.

FIG. 19 illustrates another method 500 for attaching a headrest, such as the headrests of FIGS. 6-17, to a spa. In some embodiments, the method 500 includes selecting a headrest, at 505. In some embodiments, the headrest includes a pillow, and a manifold to (a) receive the pillow and (b) to selectively engage a selectively removable spa seatback. The method 500 can also include engaging a front plate of a selectively removable spa seatback, at 510. In some embodiments, the front plate of the selectively removable spa seatback is engaged or otherwise interfaced by at least a portion of the pillow of the headrest. For example, the pillow can include a flat portion and a curved portion, where the curved portion engages or otherwise interfaces with at least a portion of a top of the front plate of the selectively removable spa seatback.

In some embodiments, the method 500 further includes engaging top wings of a back manifold of the selectively removable spa seatback, at 515. For example, in some embodiments, the top wings of the back manifold of the selectively removable spa seatback can be engaged by one or more components of the manifold, such as by (a) opposing brackets disposed on a bottom surface of the manifold and (b) clamp portions of the manifold, where the clamp portions extend downwardly from the bottom surface of the manifold. In some embodiments, the back manifold of the selectively removable spa seatback is slid into engagement with one or both the of (a) opposing brackets and (b) clamp portions of the manifold.

The method 500 can additionally include inserting the assembled selectively removable spa seatback and headrest to the spa, at 520. As before, the assembled selectively removable spa seatback and headrest can be inserted into a position within the spa corresponding to a seat to be occupied by a user. In some embodiments, the method 400 can include inserting more than one assembled selectively removable spa seatback and headrest into the spa.

Additional Terms and Definitions

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular water-containing vessel (e.g., a spa); however, other vessels (e.g., pools, tubs, swim spas, etc.) are also contemplated. A spa is also known in the industry as a hot tub and is generally formed of a concave shell to receive and contain water. Structures, such as a jet, can extend through the concave shell to move water from a surface outside the spa to a surface inside the spa or shell.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A headrest for a selectively removable spa seatback, the headrest comprising:

a pillow having a curved portion and a flat portion; and a manifold comprising:

a platform to receive the pillow, the platform having opposing divots on a top surface of the platform for engaging the flat portion of the pillow and opposing brackets extending downwardly from a bottom surface of the platform to slidably engage the selectively removable spa seatback;

a body extending from the bottom surface of the platform, the body including a pair of arms, where each arm of the pair includes a winged portion for engaging the selectively removable spa seatback and a clamp portion for engaging the selectively removable spa seatback, the winged portion engaging the selectively removable spa seatback orthogonally to the clamp portion; and a constraining plate disposed over a tab formed by the body, the constraining plate for constraining a movement of the winged portion of the body.

2. The headrest of claim 1, wherein the curved portion of the pillow covers at least a top portion of a front plate of the selectively removable spa seatback.

3. The headrest of claim 1, wherein the pillow comprises opposing protrusions extending from an inner surface of the pillow, the opposing protrusions for interfacing with the opposing divots on the top surface of the platform.

4. The headrest of claim 1, wherein the clamp portion of each arm of the pair of arms of the body is aligned with a corresponding bracket of the opposing brackets on the bottom surface of the platform, such that a back manifold of the selectively removable spa seatback is received by the clamp portions of the body and the corresponding opposing brackets on the bottom surface of the platform.

5. The headrest of claim 1, wherein the clamp portion of each arm of the pair of arms of the body comprises a left clamp portion and a right clamp portion and wherein the opposing brackets extending downwardly from the bottom surface of the platform comprises a left bracket and a right bracket.

6. The headrest of claim 5, wherein the left clamp portion is substantially aligned with the left bracket and the right clamp portion is substantially aligned with the right bracket, such that a back manifold of the selectively removable spa seatback is received by the aligned left clamp portion and left bracket, and the aligned right clamp portion and right bracket.

7. The headrest of claim 1, wherein the manifold further comprises a handle disposed between the opposing brackets on the bottom surface of the platform.

8. The headrest of claim 1, wherein the manifold further comprises a compartment for wireless electricity transmission components.

9. The headrest of claim 1, wherein the curved portion of the pillow includes a cut-out to accommodate a neck of a user of the headrest.

10. The headrest of claim 1, wherein the headrest engages with the selectively removable spa seatback and does not engage with components of a spa.

11. The headrest of claim 1, wherein the opposing brackets slidably engage a back of the selectively removable spa seatback.

12. A method of connecting a headrest to a spa, the method comprising:

selecting a headrest, the headrest comprising a pillow, and a manifold to (a) receive the pillow and (b) to selectively engage a selectively removable spa seatback;

attaching the headrest to the selectively removable spa seatback; and inserting the selectively removable spa seatback, with the attached headrest, within a cavity of the spa.

13. The method of claim 12, wherein attaching the headrest to the selectively removable spa seatback comprises:

engaging a front plate of the selectively removable spa seatback by a curved portion of the pillow; and engaging a back manifold of the selectively removable spa seatback by the manifold.

14. The method of claim 13, wherein engaging the back manifold of the selectively removable spa seatback comprises:

sliding top wings of the back manifold of the selectively removable spa seatback into (a) opposing brackets disposed on a bottom surface of the manifold and (b) clamp portions of the manifold, where the clamp portions extend downwardly from the bottom surface of the manifold.

15. A method of connecting a headrest to a spa, the method comprising:

selecting a headrest, the headrest comprising a pillow, and a manifold to (a) receive the pillow and (b) to selectively engage a selectively removable spa seatback;

engaging a front plate of the selectively removable spa seatback by a curved portion of the pillow;

engaging top wings of a back manifold of the selectively removable spa seatback by (a) opposing brackets disposed on a bottom surface of the manifold and (b) clamp portions of the manifold, where the clamp portions extend downwardly from the bottom surface of the manifold; and inserting the selectively removable spa seatback with the headrest attached to the spa.

* * * * *